United States Patent [19]

Kapp et al.

[11] Patent Number: 4,662,765

[45] Date of Patent: May 5, 1987

[54] INTEGRATED PRINTER AND PAPER FEEDING APPARATUS

[75] Inventors: Ludwig J. Kapp, Blairstown; Dominick Fazio, Whippany; Tadeusz Staniszewski, Budd Lake, all of N.J.

[73] Assignee: Ziyad Incorporated, Denville, N.J.

[21] Appl. No.: 819,469

[22] Filed: Jan. 15, 1986

Related U.S. Application Data

[63] Continuation of Ser. No. 534,129, Sep. 20, 1983, abandoned.

[51] Int. Cl.[4] ..... B41J 11/48; B41J 11/50; B41J 29/08; B65H 3/44

[52] U.S. Cl. ..... 400/595; 400/599; 400/605; 400/607.2; 400/607.3; 400/603.1; 400/608.1; 400/629; 400/636.1; 400/690.4; 400/690.1; 400/708; 271/2; 271/9; 271/186

[58] Field of Search ..... 400/605, 61, 608–608.1, 400/608.4, 607–607.2, 603–603.1, 595, 599, 607.3, 624–626, 629–633, 636, 636.1–636.3, 690–690.4, 708; 271/2, 4–5, 7, 9, 119, 109–110, 113, 116, 121, 123, 124, 126, 186, 259; 355/14 CH

[56] References Cited

U.S. PATENT DOCUMENTS

| | | | |
|---|---|---|---|
| 2,130,101 | 9/1938 | Ritzerfeld | 271/2 |
| 2,368,519 | 1/1945 | Burckhardt et al. | 271/2 |
| 2,443,953 | 6/1948 | Gillespie | 271/2 X |
| 3,065,835 | 11/1962 | Drillick | 271/227 X |
| 3,070,204 | 12/1962 | Bradshaw | 400/625 |

(List continued on next page.)

FOREIGN PATENT DOCUMENTS

| | | | |
|---|---|---|---|
| 26977 | 4/1981 | European Pat. Off. | 400/636 |
| 35178 | 9/1981 | European Pat. Off. | 400/636.2 |
| 3235 | 1/1981 | Japan | 271/9 |
| 145047 | 11/1981 | Japan | 271/9 |
| 142381 | 9/1982 | Japan | 400/629 |
| 142382 | 9/1982 | Japan | 400/629 |
| 166242 | 10/1982 | Japan | 271/9 |
| WO82/00022 | 1/1982 | PCT Int'l Appl. | 400/636 |
| 503591 | 4/1971 | Switzerland | 400/636 |
| 2026392 | 2/1980 | United Kingdom | 400/708 |
| 2035218 | 6/1980 | United Kingdom | 400/633 |
| 2101354 | 1/1983 | United Kingdom | 271/9 |
| 414816 | 8/1974 | U.S.S.R. | 271/9 |

OTHER PUBLICATIONS

"Automatic Document Feeder Prefeed" IBM Technical Disclosure Bulletin, vol. 25, No. 1, Jun. 1982, p. 248.

"Document Exit Tray" IBM Tech. Disc. Bulletin, vol. 15, No. 7, Dec. 72, p. 2194.

(List continued on next page.)

*Primary Examiner*—E. H. Eickholt

*Attorney, Agent, or Firm*—Lerner, David, Littenberg, Krumholz & Mentlik

[57] ABSTRACT

There is illustrated and described a printing device having an integrated paper feeding apparatus adapted for supplying individual sheets of paper to the printing device to effect printing thereon. The integrated printer and paper feeding apparatus for the present invention is particularly suitable for use in word processing systems where the information to be printed in hard copy is contained in a memory device such as a floppy disk or the like. The apparatus may be directly linked to word processing equipment to receive the text of material to be printed. In addition to having the capability of automatically feeding individual sheets of paper from one or more paper trays to the printing device, the apparatus includes an automatic envelope supply mechanism for supplying individual envelopes to the printing device, as well as a manual paper feed option. After effecting printing on the paper or envelope, an ejector mechanism ejects the printed paper from the apparatus and into a receptacle in collated form. All components of the apparatus are enclosed in a single housing having suitable sound reducing material provided to reduce the operational noise of the apparatus. The housing is provided with openings to receive the paper trays and an envelope tray, as well as a top liftable cover designed to provide easy access to the components of the apparatus within the housing.

94 Claims, 19 Drawing Figures

U.S. PATENT DOCUMENTS

| | | | |
|---|---|---|---|
| 3,382,778 | 5/1968 | Berkowitz | 271/2 |
| 3,549,067 | 12/1970 | Robbins | 271/2 |
| 3,762,813 | 10/1973 | Fowlie et al. | 271/9 |
| 3,790,158 | 2/1974 | Summers et al. | 271/4 |
| 3,790,161 | 2/1974 | Ericsson | 271/9 |
| 3,948,511 | 4/1976 | Smith et al. | 271/116 |
| 3,970,384 | 7/1976 | Yamamoto et al. | 271/259 |
| 4,107,700 | 8/1978 | Jornod | 493/446 |
| 4,136,862 | 1/1979 | Kunz et al. | 271/186 |
| 4,190,246 | 2/1980 | Sasuga | 271/265 |
| 4,212,456 | 7/1980 | Ruenzi | 271/186 |
| 4,215,762 | 8/1980 | Cunningham et al. | 400/690.4 |
| 4,218,128 | 8/1980 | Satomi et al. | 271/9 |
| 4,252,453 | 2/1981 | Estabrooks | 400/613.2 |
| 4,265,440 | 5/1981 | Shibazaki et al. | 271/259 |
| 4,268,021 | 5/1981 | Rutishauser et al. | 271/116 |
| 4,272,181 | 6/1981 | Treseder | 271/186 |
| 4,275,969 | 6/1981 | Matsuhisa et al. | 400/625 |
| 4,326,815 | 4/1982 | Kapp | 400/625 |
| 4,332,375 | 1/1982 | Tsubo | 271/9 |
| 4,368,994 | 1/1983 | Sweeney | 400/636.2 |
| 4,383,756 | 5/1983 | Hanamoto et al. | 355/14 CU |
| 4,386,769 | 6/1983 | Ito et al. | 271/9 |
| 4,388,008 | 6/1983 | Greene et al. | 271/9 X |
| 4,391,542 | 7/1983 | Baitz | 400/625 X |
| 4,407,597 | 10/1983 | Kapp | 400/629 |
| 4,417,282 | 11/1983 | Yamamoto | 271/9 |
| 4,431,323 | 2/1984 | Kulow | 271/2 |
| 4,436,404 | 3/1984 | Simmons et al. | 271/186 |
| 4,438,915 | 3/1984 | Akamatsu et al. | 271/119 |
| 4,438,917 | 3/1984 | Janssen et al. | 400/630 |
| 4,449,705 | 5/1984 | Shibuya et al. | 271/9 |
| 4,453,819 | 6/1984 | Wada et al. | 271/186 |
| 4,487,506 | 12/1984 | Repp et al. | 271/4 |

OTHER PUBLICATIONS

"Right Hand Margin Set & Print Inhibit" IBM Tech. Discl. Bulletin, vol. 20, No. 10, Mar. 78, pp. 3996-3997.

"Dynamic Sheet Length Sensing" IBM Tech. Discl. Bulletin, vol. 18, No. 2, Jul. 75, pp. 330-331.

"Short-Paper Detection in Paper Path" IBM Tech. Discl. Bulletin, vol. 24, No. 1B, Jun. 1981, pp. 547-548.

"Multiple Bin Sheet Feed Apparatus Utilizing a Single Feed Clutch", IBM Tech. Disc. Bulletin, vol. 16, No. 9, Feb. 74, pp. 2966-2967.

"Sheet Feed Apparatus" IBM Tech. Discl. Bulletin, vol. 15, No. 7, Dec. 1972, pp. 2229-2230.

"Paper Feed Module" IBM Tech. Discl. Bulletin, vol. 23, No. 7A, Dec. 1980, pp. 2677-2678.

"Document Sensor" IBM Tech. Disc. Bulletin, vol. 25, No. 10, Mar. 1983, p. 5290.

"Document Picker & Separator" IBM Tech. Discl. Bulletin, vol. 14, No. 8, 1/82, pp. 2265-2266.

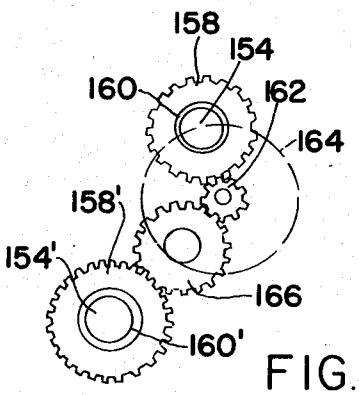
FIG. 7
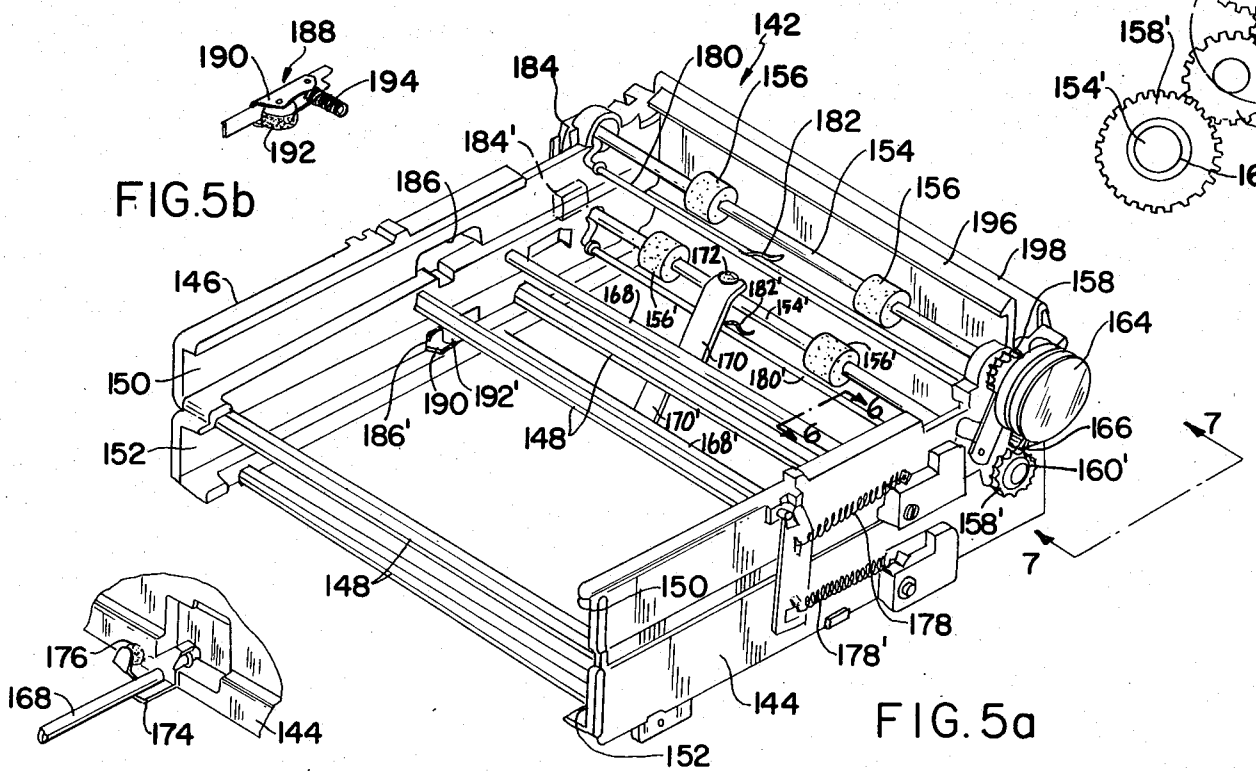
FIG. 5a
FIG. 5b
FIG. 6

INTEGRATED PRINTER AND PAPER FEEDING APPARATUS

This is a continuation of application Ser. No. 534,129, filed Sept. 20, 1983 and now abandoned.

BACKGROUND OF THE INVENTION

The present invention relates in general to a hard copy printing device suitable for use in conjunction with word processing machines and, more particularly, to an integrated printer and paper feeding apparatus which will continuously feed individual sheets of paper and envelopes from an internal supply thereof along a feed path past an integrated printing device to effect printing thereon.

Tremendous advances have been made in the last few years in automating office procedures. Conventional typewriters have grown into mini-computers performing word processing, storage and other functions. The speed at which these machines produce words on paper is increasing at a rapid rate. As added speed and sophistication are developed into such machines, the actual putting of words onto paper becomes auxiliary to the main function of collecting and organizing the information into a format to be printed. In order to have flexibility and speed, many systems have been developed where an operator manipulates words on a cathode ray tube or other word processing equipment until the final copy is in the format desired. With all of these advances, it has developed that today one of the major bottlenecks in terms of time, and therefore usefulness of this equipment, is the rate at which paper can be brought to and moved past a printing head to produce the final hard copy.

Of course, it is possible to use continuous sheets of perforated paper, as is commonly done in computer applications, having sprocket holes along the sides thereof to continuously feed and move the paper through an impact printer. This, however, requires special paper which is not suitable to the many requirements for which normal typewriting is employed.

Many machines exist, both copying machines and printing machines, which automatically feed paper past a printing or reproducing station. These machines are normally run synchronously such that prior to the time that paper is fed, the information to be imparted to the paper is already organized and the paper is moved past the printing head in a continuous fashion. This is not generally suitable for impact printing devices since impact printing is accomplished with the paper stationary rather than moving, and further the adaption of normal typewriting type printing requires the moving of paper not only on an intermittent basis, but also in the forward and reverse direction in accordance with the information to be typed. Still further, with such existing equipment, it is generally not possible to manually feed separate sheets of paper, which may be of a different size or thickness, such as, for example, envelopes, without disconnecting the equipment from the printing apparatus.

In U.S. Pat. No. 4,326,815, which patent is assigned to the same assignee of the present invention, there is disclosed a paper feeding apparatus which is capable of being retrofitted with respect to existing printing devices, i.e., distributed as an aftermarket product, as well as being capable of being sold and distributed with the printing device. The retrofit characteristic of this paper feeding apparatus lends itself to conform to the requirements of existing impact printing devices rather than requiring the radical modification thereof so as to conform with the needs of high-speed paper feeding. However, although such paper feeding apparatus has been commercially successful, the retrofit nature of the paper feeding apparatus requires separate installation procedures, separate maintenance to both the paper feeding apparatus and the paper printing device, additional office space to accommodate the retrofitted paper feeding apparatus and, often requires a separate and special sound-proofing enclosure to reduce the noise level resulting from the operation of both the paper feeding and paper printing device.

SUMMARY OF THE INVENTION

It is broadly an object of the present invention to provide an integrated printer and paper feeding apparatus which overcomes or avoids one or more of the foregoing limitations resulting from the use of the above-mentioned prior art retrofitted paper feeding apparatus and, which fulfills the specific requirements of such an integrated printer and paper feeding apparatus for use with modern-day computers and high-speed word processing equipment. Specifically, it is within the contemplation of one aspect of the present invention to provide an integrated printer and paper feeding apparatus constructed of a housing, paper storing means within the housing for storing a plurality of individual sheets of paper, paper feeding means within the housing for feeding individual sheets of paper from the paper storing means along a paper feed path, printing means within the housing for printing on a sheet of paper, paper advancing means arranged within the housing along the paper feed path for advancing a sheet of paper past the printing means to effect printing thereon and control means for controlling the operation of the paper feeding means, the printing means and the paper advancing means.

In accordance with another aspect of the present invention, the integrated printer and paper feeding apparatus includes a manual paper feed path for manually feeding individual sheets of paper from a supply external to the housing to the paper advancing means, an envelope feed path for feeding individual envelopes from an internal supply of envelopes within the housing to the paper advancing means, paper receptacle means arranged along a paper exit path for receiving and storing printed sheets of paper ejected from the apparatus, a cover overlying the paper receptacle means wherein the paper receptacle means is arranged within the housing overlying the printing means and sound absorbing material arranged within the housing for absorbing sound produced by the operation of the apparatus.

In accordance with still another aspect of the present invention, the integrated printer and paper feeding apparatus includes a paper gripping mechanism constructed of paper gripping means movable between a first and second position adjacent the paper advancing means for gripping a sheet of paper therebetween when the paper gripping means is in the first position, a first member pivotable between a first and second position adjacent a second member along a paper exit path for gripping a sheet of paper therebetween when the first member is in the second position, paper gripping control means for controlling the movement of the paper gripping means and the first member between the first and second positions, and connecting means for connecting the paper gripping means and the first member to the paper gripping control means, the paper gripping means moving from the first to the second position during operation of the paper gripping control means in one direction while the first member remains in the first position and the first member pivoting from the first to the second position during operation of the paper gripping control means in another direction while the paper gripping means remains in the first position.

According to yet another aspect of the present invention, the paper gripping mechanism of the integrated printer and paper feeding apparatus includes a first arm having a portion pivotly mounted within the housing, the first arm having the paper gripping means attached at one end thereof, a second arm having a portion pivotally mounted within the housing, the second arm having the one member attached at one end thereof and the connecting means having a retaining member at either end thereof slidingly captured within an opening provided within the other end of the first and second arms.

According to yet another aspect of the present invention, the integrated printer and paper feeding apparatus includes envelope storing means for storing a plurality of individual envelopes in a stack, envelope feeding means for feeding individual envelopes from the stack to the paper advancing means along an envelope feed path, the envelope feeding means arranged along one side of the envelope feed path for engagement with a first envelope in the stack, and an envelope stripper for the individual stripping of envelopes from the envelope storing means, the envelope stripper constructed of envelope stripping means arranged along the other side of the envelope feed path for engaging an adjacent second envelope within the stack and retaining the second envelope while permitting the first envelope to be fed from the stack to the paper advancing means by operation of the envelope feeding means.

According to yet another aspect of the present invention, the paper storing means of the integrated printer and paper feeding apparatus is constructed of a first and second paper tray each having a plurality of individual sheets of paper therein, the paper feeding means constructed of guide means for defining the paper feed path between the paper storing means and the paper advancing means and first and second transversely spaced feed rollers for feeding a sheet of paper respectively from the first and second paper trays along the paper feed path to the paper advancing means and, wherein the control means for the paper feed means is constructed of a drive gear operatively coupled to the first feed roller through a first clutch operable upon rotation in one direction and operatively coupled to the second feed roller through an idler gear and a second clutch operable upon rotation in the one direction.

According to yet another aspect of the present invention, the integrated printer and paper feeding apparatus includes paper sensing means arranged on the printing means for detecting the edge of a sheet of paper being fed along the paper feed path by the paper advancing means and printer control means responsive to the paper sensing means for positioning the printing means in a desired printing position with respect to the edges of a sheet of paper to effect printing thereon.

In accordance with the present invention, there is further provided a paper gripping mechanism for a printing device, the printing device including paper advancing means for advancing a sheet of paper within the printing device and paper ejecting means for removing the sheet of paper from the printing device along a paper exit path, the paper gripping mechanism constructed of paper gripping means movable between a first and second position adjacent the paper advancing means for gripping a sheet of paper therebetween when the paper gripping means is in the first position, the paper ejecting means including a first and second member, the first member being pivotable from a first position spaced from the second member to a second position in engagement with the second member along the paper exit path for gripping a sheet of paper therebetween when the first member is in the second position, and control means movable in a first and second direction for controlling the pivoting movement of the paper gripping means and the first member between the first and second positions, the paper gripping means moving from the first to the second position during operation of the control means in the first direction and the first member pivoting from the first to the second position during operation of the control means in the second direction.

Still further in accordance with the present invention there is provided an envelope stripper mechanism for the feeding of envelopes in a printing device, the printing device including paper advancing means for advancing an envelope within the printing device, the envelope stripper mechanism constructed of envelope storing means for storing a plurality of individual envelopes in a stack, envelope feeding means for feeding individual envelopes from the stack to the paper advancing means along an envelope feed path, the envelope feeding means arranged along one side of the envelope feed path for engagement with a first envelope within the stack, and envelope stripping means arranged along the other side of the envelope feed path for engaging an adjacent second envelope within the stack and retaining the second envelope while permitting the first envelope to be fed from said stack to the paper advancing means by operation of the envelope feeding means.

Yet still further in accordance with the present invention, there is provided a print head assembly for a printing device, the printing device including paper advancing means for advancing a sheet of paper within the printing device along a paper feed path, the print head assembly constructed of printing means for printing on a sheet of paper advanced along the paper feed path by the paper advancing means, paper sensing means arranged on the printing means for sensing the edge of a sheet of paper being fed along the paper feed path by the paper advancing means and control means responsive to the paper sensing means for positioning the printing means in a desired printing position with respect to the edges of a sheet of paper to effect printing thereon.

BRIEF DESCRIPTION OF THE DRAWINGS

The above description, as well as further objects, features and advantages of the present invention will be more fully understood by reference to the following detailed description of the presently preferred but nonetheless illustrative integrated printer and paper feeding apparatus in accordance with the present invention when taken in conjunction with the accompanying drawings, wherein:

FIGS. 5*a* and 5*b* are perspective views of the paper loading assembly in accordance with the present invention showing various components thereof;

FIG. 6 is a perspective view taken along lines 6—6 of FIG. 5*a* showing the cam follower means of the paper loading assembly;

FIG. 7 is a side elevational view taken along lines 7—7 of FIG. 5*a* showing the one-way clutch gear arrangement of the paper loading assembly;

DETAILED DESCRIPTION OF THE PREFERRED EMBODIMENT

Figure 1:
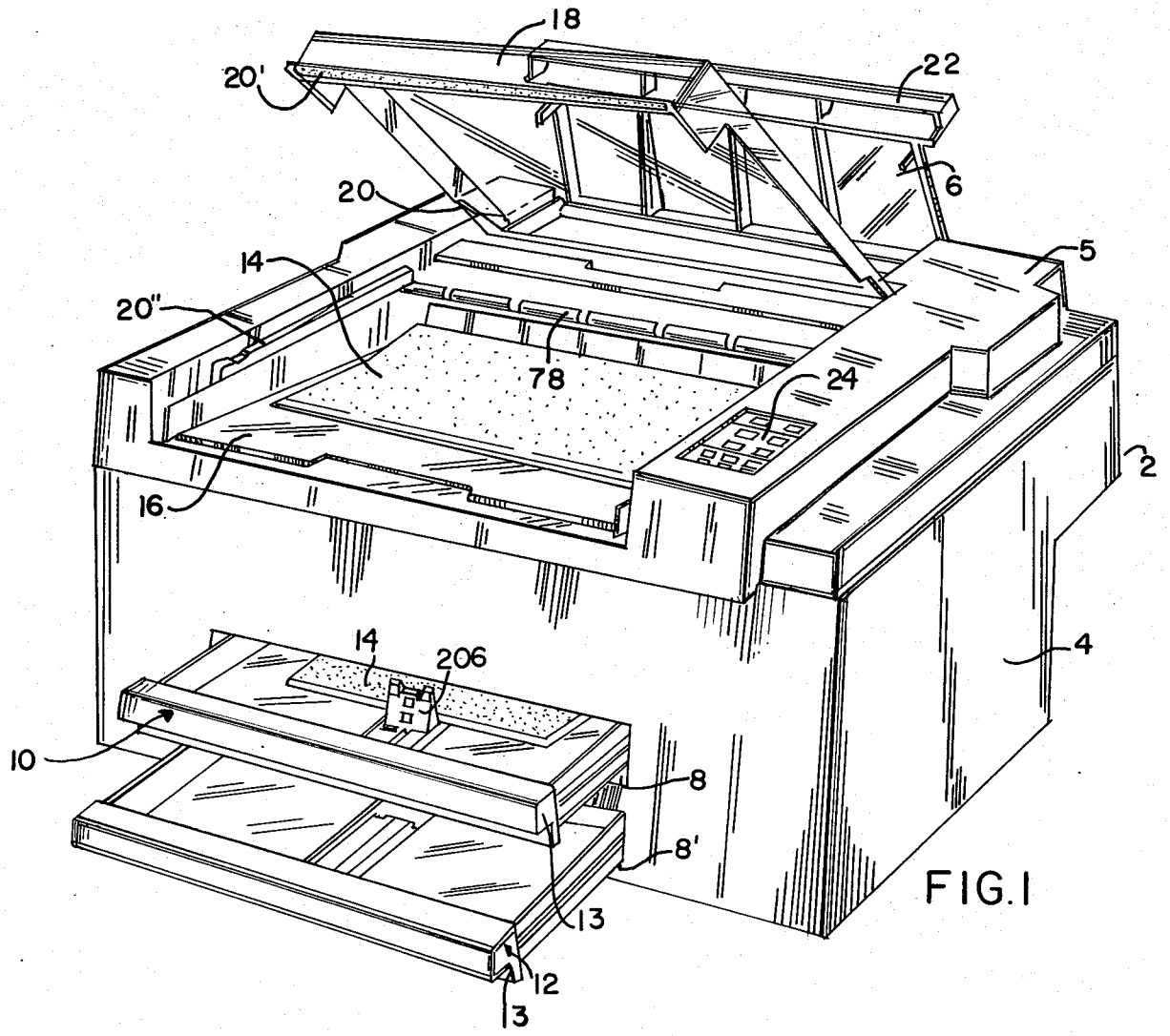
FIG. 1 is a perspective view of the integrated printer and paper feeding apparatus in accordance with the present invention showing a sound reducing housing including a pair of paper trays, a paper stacking tray arranged underlying a sound reducing cover, an envelope compartment cover and a control panel.
Figure 2:
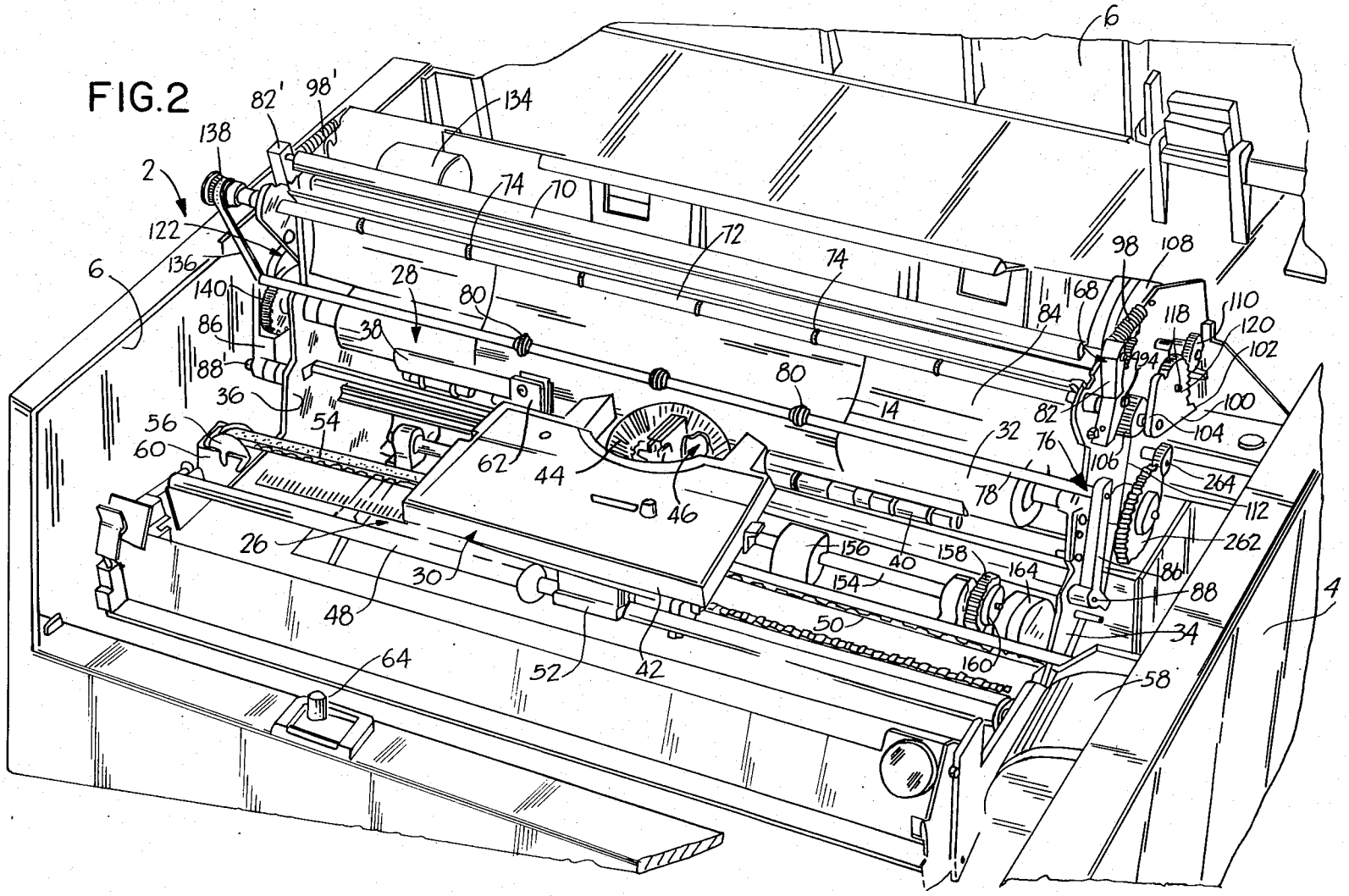
FIG. 2 is a perspective view of the integrated printer and paper feeding apparatus of FIG. 1 with a top portion of the sound reducing housing, including the paper stacking tray and sound reducing cover, removed to show various components thereof.

Referring now to the drawings wherein like reference characters represent like elements, there will now be described the construction and operation of an integrated printer and paper feeding apparatus in accordance with the present invention. Specifically referring to FIG. 1, there is illustrated an integrated printer and paper feeding apparatus constructed in accordance with the preferred embodiment and generally designated by reference character 2. The integrated printer and paper feeding apparatus 2 is constructed from a sound reducing housing 4 having a top cover 5 and sound reducing material 6 lining the inside walls thereof, as generally shown in FIG. 2. One such material suitable for reducing the noise level produced as a result of the operation of the integrated printer and paper feeding apparatus 2 is urethane cellular acoustical foam; however, other such materials may also be used in accordance with the present invention. Arranged on the face of the housing 4 are a pair of adjacent rectangular openings 8, 8′ for receiving a pair of paper trays 10, 12 provided for storing a first and second plurality of individual sheets of paper 14 for printing thereon. The paper trays 10, 12 are provided with closures 13 to close the openings 8, 8′ when the paper trays are inserted into the housing 4. The paper trays 10, 12 may also be provided with suitable sound reducing material (not shown) to assist in elimination of noise from operation of the apparatus 2, in particular, provided as a seal around the closures 13 to engage the surface of the housing 4. A paper stacking tray 16 is removably provided within the top cover 5 of the housing 4 for receiving in collated arrangement individual sheets of paper 14 having printing thereon upon being ejected from the integrated printer and paper feeding apparatus 2.

A sound reducing cover 18 is provided overlying the paper stacking tray 16. In addition to protecting the collated printed paper 14 within the paper stacking tray 16, the sound reducing cover 18 functions to reduce the noise produced by the operation of the integrated printer and paper feeding apparatus 2. In this regard, the sound reducing cover 18 is removably sealed to the top cover 5 of the housing 4 by strips of rubber like gasket material 20, 20′ arranged along the edges of the sound reducing cover and the provision of a similar rubber strip 20″ arranged adjacent the paper stacking tray 16 within the top cover for sealing engagement with the side edges of the sound reducing cover. Located behind the cover 18 is an envelope compartment cover 22 for providing access to a stack of individual envelopes to be supplied to the integrated printer and paper feeding apparatus 2. As shown, the envelope compartment cover 22 is provided with sound reducing material 6 on its inside surface to reduce the noise resulting from the operation of the integrated printer and paper feeding apparatus 2. The user operation of the integrated printer and paper feeding apparatus 2 is controlled through the control panel 24 mounted in a convenient location to the top cover 5 of the housing 4. Thus, it can be appreciated that the sound reducing housing 4 of the integrated printer and paper feeding apparatus 2, in addition to being compact, occupying a minimum of space and being of pleasing design, significantly reduces the noise level attributable to the operation of the integrated printer and paper feeding apparatus while providing easy access to the components thereof through the top cover 5. These and other attributes of the present invention will be readily appreciated to those having ordinary skill in the art in consideration of the following further detailed description of the construction and operation of an integrated printer and paper feeding apparatus 2 in accordance with the present invention.

Figure 14:
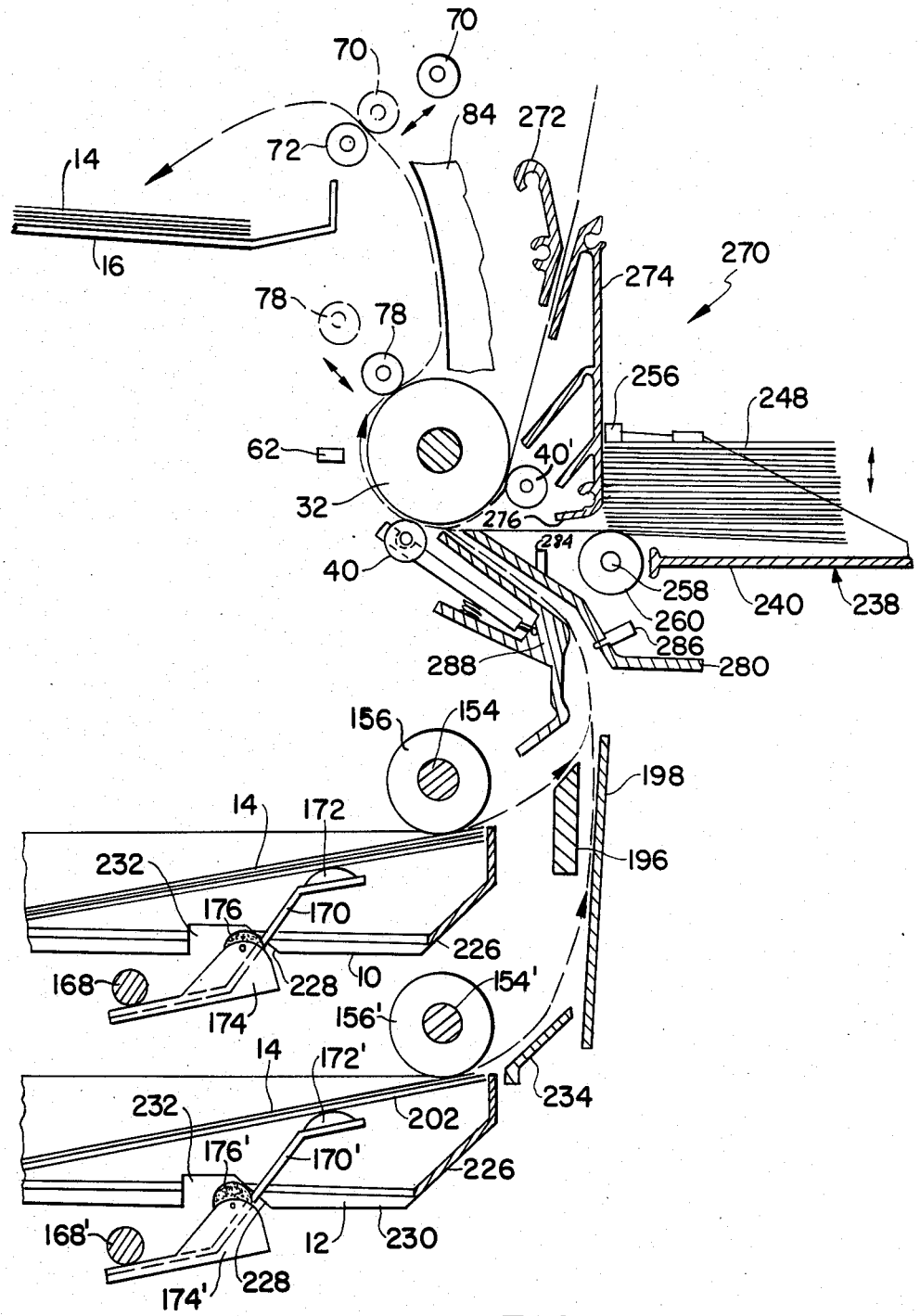

Referring now to FIG. 2, the integrated printer and paper feeding apparatus 2 includes a printing device generally designated by reference character 26. The printing device 26 is constructed from a platen assembly 28 which is adapted to advance a sheet of paper 14 within the integrated printer and paper feeding apparatus 2 and a print head carriage assembly 30 which is adapted to traverse back and forth across the transverse length of the platen assembly 28 to effect printing on the paper. The platen assembly 28 is constructed from a rotatable platen 32 transversely extending between a pair of side platen 34, 36 and which is adapted to rotate about a transversely extending axis. A paper guide 38 is arranged adjacent to and extending along a substantial portion of the longitudinal extent of the platen 32 for guiding a sheet of paper 14 from a paper feed path upwardly around the platen. A plurality of spaced apart pressure rollers 40 are supported by paper guide plate 288 in engagement with the platen 32 along a lower front portion as shown in FIG. 2 and FIG. 14. A second plurality of spaced apart pressure rollers 40′ (see FIG. 14) are provided along a middle rear portion of the platen 32 for manual feeding of sheets of paper as more fully described hereinbelow. As shown in FIG. 2, a sheet of paper 14 to be printed on is received between the platen 32 and the paper guide 38 and is advanced in a forward and a reverse direction by rotation of the platen and engagement with the pressure rollers 40.

The print head carriage assembly 30 is constructed of a ribbon cartridge 42 for storage of a printing ribbon, a character print wheel 44, a print wheel retainer 46 for removably securing the print wheel to the print head carriage assembly 30, and a print wheel motor and encoder (not shown). The ribbon cartridge 42, print wheel 44 and print wheel retainer 46 may be of conventional construction and accordingly the details of such construction will not be described herein. The print head carriage assembly 30 is movably mounted adjacent the platen 32 to a pair of parallel spaced apart transversely extending carriage rails 48, 50 by means of, for example, a pair of slide bushings 52 of which only the forwardmost slide bushing is shown. The print head carriage assembly 30 is secured to the ends of a belt 54 which extends longitudinally between carriage rails 48, 50. The belt in turn engages an idler pulley 56 and a drive pulley (not shown). As shown in FIG. 2, the idler pulley 56 is arranged at the leftmost end of the apparatus 2 where it is secured by bracket 60 to the side plate 36. The drive pulley is at the rightmost end of the apparatus 2 and engages a carriage drive motor 58.

As thus far described, the print wheel 44 is carried by the movable print head carriage assembly 30 which traverses across the transverse extent of the platen 32 by means of the carriage drive motor 58. The print wheel 44 is arranged to be closely spaced from the platen 32 so that printing in lines can be achieved on the paper 14 as the print carriage assembly 30 traverses between the ends of the platen. Alternatively, the platen 32 could be carried by a carriage and moved transversely past the print wheel 44. During the printing operation, the platen 32 serves to rotate intermittently about its transverse axis to advance the sheet of paper 14 longitudinally relative to the print wheel 44 for the printing of the next line thereon by virtue of the transverse movement of the print wheel with respect thereto. In the operation of the printing device 26 as thus far described and shown in FIG. 2, printing is accomplished by transversely moving the print carriage assembly 30 relative to the paper 14 and then advancing the paper longitudinally by rotation of the platen 32 and engagement of the pressure rollers 40 to permit the print carriage assembly to effect the next line of printing. This printing operation may be as in a conventional typewriter from left to right, or the printing may be from left to right for one line of print with the next line of print being effected by movement of the print carriage assembly 30 from right to left. This latter means of printing is commonly used in many present-day word processing systems.

The integrated printer and paper feeding apparatus 2 in accordance with the present invention is mainly designed for use where the printing device 26 is of the type having automatic printing or typing capabilities, i.e., printing systems or devices in which a complete page of print is effected automatically without or with a minimal amount of instructions from the user. In such systems, the text of the matter to be printed may have been previously stored on a disk or similar recording device, or may be in the memory of a cathode ray tube on which a user has arranged the matter or information in a desired format. When desired, the system simply prints the stored information onto sheets of paper in a continuous manner.

Generally, in the printing operation, the matter or information is printed one line at a time, with the paper 14 then being automatically advanced for effecting printing on the next line, and so on until an entire page is printed. Such printing devices 26 are generally of impact printing type, i.e., a hammer impacts the print wheel which in turn impacts the paper 14 against the platen 32 to effect the printing. However, it should be appreciated that the integrated printer and paper feeding apparatus 2 in accordance with the present invention could also be used with other types of printing devices 26, such as, for example, ink jet printers, matrix printers, direct thermal printers, thermal transfer printers, laser printers, line printers, and/or non-impact electrical-static printers. Further in accordance with the present invention, the print head carriage assembly is provided with a sensor 62, whose function is to be more fully described hereinafter and the housing 4 is provided with a panel switch 64 which functions as a lockout switch to shut off the power to the intergrated printer and paper heading apparatus 2 when the stacking tray 16 on the top cover 5 is lifted, for example, to effect repair and maintenance.

Figure 3:
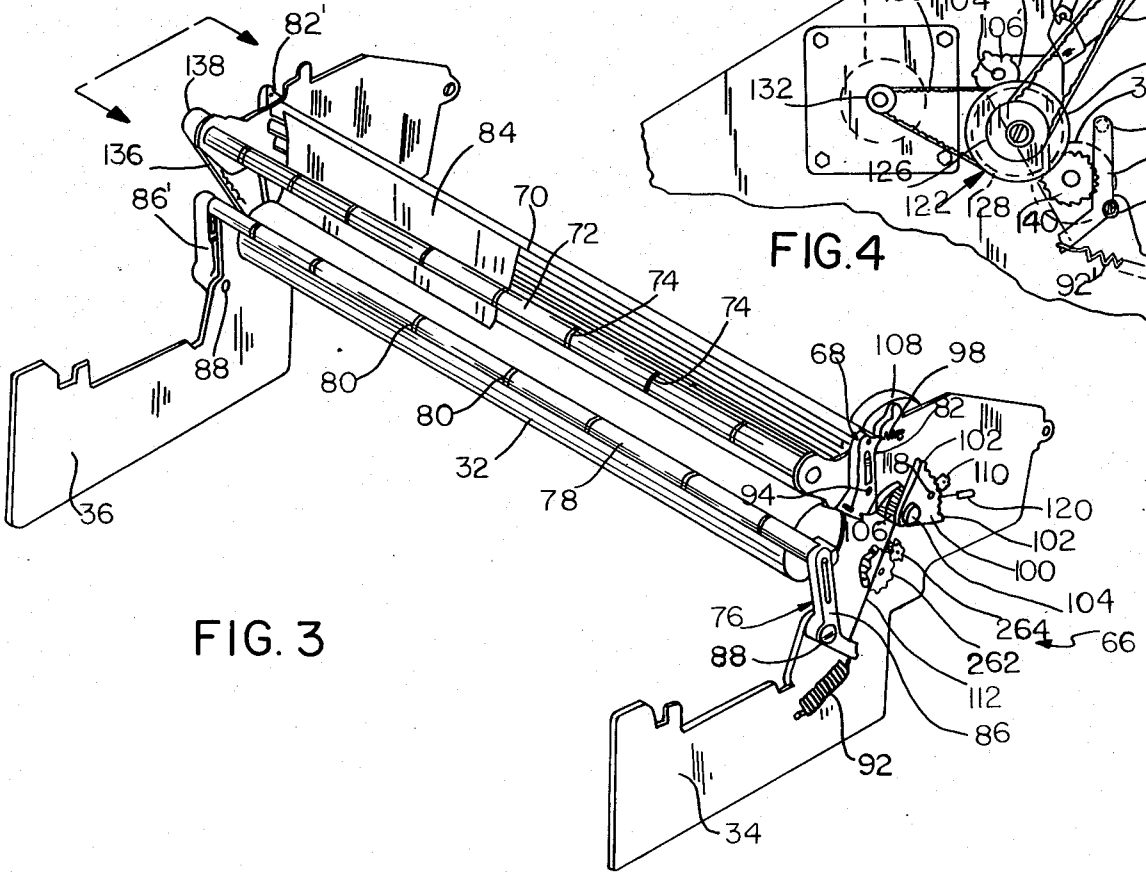
FIG. 3 is a perspective view showing the paper gripping mechanism in accordance with the present invention including paper advancing means for advancing a sheet of paper within the apparatus and paper ejecting means for ejecting a sheet of paper from within the apparatus.

Referring now to FIG. 3, there will be described the paper gripping mechanism 66 in accordance with the integrated printer and paper feeding apparatus 2 of the present invention. The paper gripping mechanism 66 includes a paper ejecting assembly generally designated by reference character 68 for ejecting a sheet of paper 14 from the printing device 26 after printing has been effected thereon. In the preferred embodiment, the paper ejecting assembly 68 is constructed from a pair of spaced apart ejector rollers 70, 72 which are suported rearwardly of the integrated printer and paper feeding apparatus 2 between the side plates 34, 36 and arranged so as to receive therebetween a sheet of paper 14 as it exits from the printing device 26 along a paper exit path. As best shown in FIG. 2, the sheet of paper 14 is guided between the spaced apart ejector rollers 70, 72 while printing is being effected thereon, the spacing of the ejector rollers serving to allow the paper 14 to move freely under the control of the platen 32. When it is desired to eject a sheet of paper 14 after the printing has been completed, or otherwise, the rear ejector roller 70 is moved towards the forward stationary ejector roller 72 to grippingly engage a sheet of paper 14 therebetween. The stationary ejector roller 72 being continuously rotated is operative by means of a plurality of equally spaced O-rings 74 to pull the sheet of paper 14 upwardly along the paper exit path and away from the printing device 26 and to stack same in collated form within the paper stacking tray 16, as shown in FIG. 1.

Likewise, the paper gripping mechanism 66 includes a platen paper gripping assembly 76 constructed of a paper bail 78 supported forward of the platen 32 between the side plates 34, 36 and movably arranged between a closed position in contact with the platen 32 and an open position spaced adjacent the platen 32 so as to receive a sheet of paper 14 therebetween. In this regard, the paper bail 78 is normally in engagement with the platen 32 by means of a plurality of equally spaced O-rings 80 or the like. As best shown in FIG. 2, a sheet of paper 14 is guided between the platen 32 and the paper bail 78 while printing is being effected thereon by the printing device 26. The engagement of the paper bail 78 with the platen 32 generally serves to allow the paper 14 to be moved smoothly under the control of the platen so as to effect a uniform and precise printing on the paper 14 by maintaining the paper in contact with the platen at the location whee the printing on the paper occurs. When it is desired to insert a new sheet of paper 14 after the printing has been completed and the previous sheet ejected by the paper ejecting assembly 68, the paper bail 78 is moved away from the platen 32 to allow the paper 14 to move freely under the control of the platen into its position in alignment with the printing device 26. Once the sheet of paper 14 has been advanced by the platen 32 into operative alignment with the printing device 26, the paper bail 78 is moved into engagement therewith prior to the printing operation.

More particularly, with reference to the paper ejecting assembly 68, the ejector rollers 70, 72 are transversely mounted between the side plates 34, 36 overlying the platen 32 along either side of a paper exit path as more clearly shown in FIG. 14. Stationary ejector roller 72 is rotationally mounted between the side plates 34, 36 forward of the paper exit path. On the other hand, ejector roller 70 is mounted to the rear of the paper exit path between a pair of ejector arms 82, 82' to alow pivotal movement of the ejector roller 70 into engagement with the stationary ejector roller 72 for engaging a sheet of paper 14 therebetween and ejecting same from the printing device 26 and into the paper stacking tray 16. Arranged along the paper exit path is provided a concave exit guide plate 84 arranged to lie just above the rotatable platen 32 adjacent the exit end thereof and extending upwardly along the paper exit path to just below the point of engagement between the ejector rollers 70, 72 for guiding a sheet of paper 14 from the printing device 26 along the paper exit path and between the ejector rollers for engagement therewith.

Figures 13A, 13B, 13C:
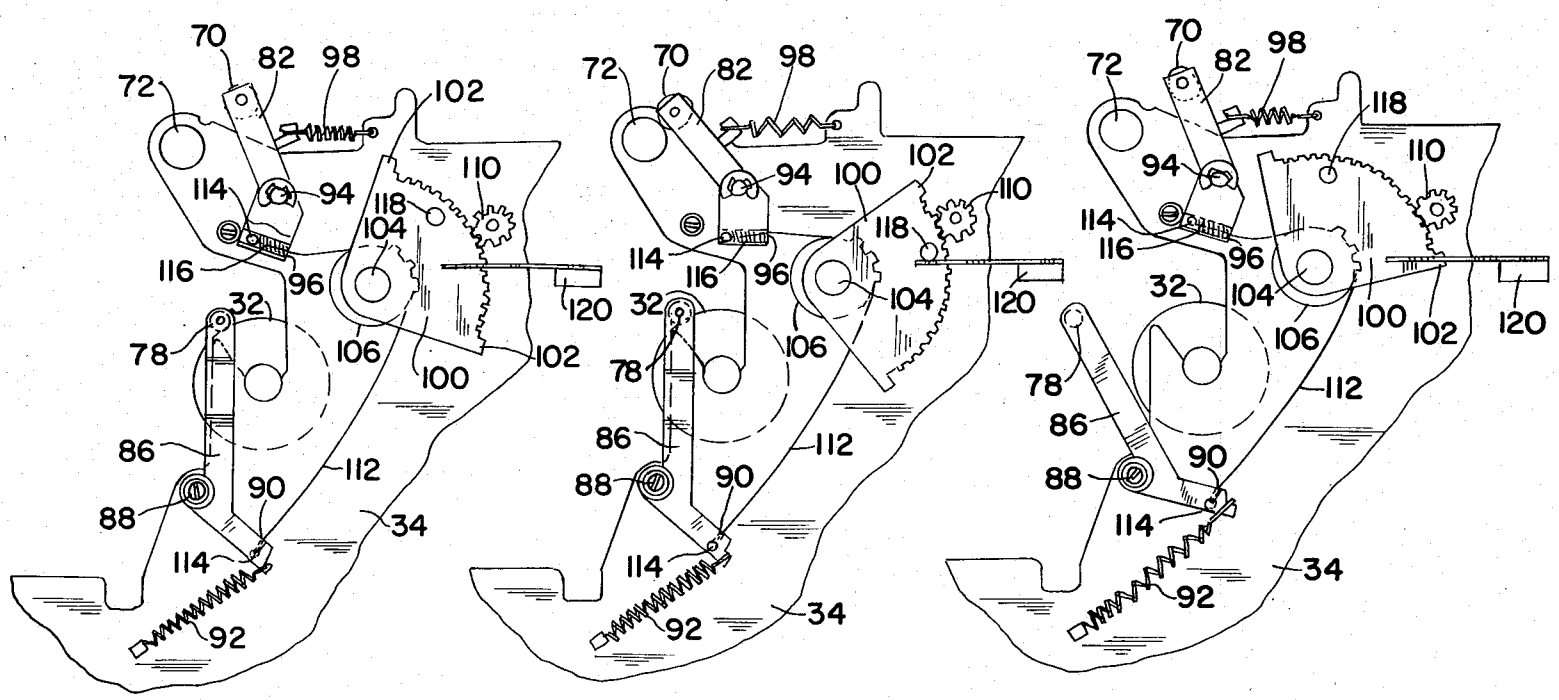
FIGS. 13*a* through 13*c* are side elevational views showing the three operative positions of the control means for the paper gripping mechanism as shown in the lower right-hand corner of FIG. 3; and, FIG. 14 is a schematic side elevational view of the integrated printer and paper feeding apparatus in accordance with the present invention showing the various paper feed and exit paths for sheets of paper and envelopes within the apparatus.

More particularly, as to the platen paper gripping assembly 76, the paper bail 78 is transversely mounted overlying a forward portion of the platen 32 between a pair of platen arms 86, 86'. As best shown in FIG. 3 and FIGS. 13*a*–13*c*, the platen arms 86, 86' are pivotally attached about pivot points 88, 88' to the side plates 34, 36 underlying the forward portion of the platen 32. The paper bail 78 is transversely mounted between the upper ends of the platen arms 86, 86' while the lower ends are provided with an opening 90. Springs 92, 92' are attached to the lower ends of the platen arms 86, 86' to normally bias the paper bail 78 into engagement with the platen 32, as best shown in FIGS. 13*a* and 13*b*. Likewise, the ejector arms 82, 82' are pivotally mounted to the side plates 34, 36 to pivot about pivot points 94, 94' which are above the rotational axis of the platen 32. The ejector roller 70 is transversely mounted between the upper ends of the ejector arms 82, 82' while the lower ends of the ejector arms are provided with an opening 96. Springs 98, 98' are secured to the upper portion of the ejector arms 82, 82' for biasing the ejector roller 70 rearward of the paper exit path and out of engagement with the ejector roller 72 to permit the upward feeding of a sheet of paper 14 between the platen 32 and paper bail 78 along the paper exit path.

The paper gripping mechanism 66, namely the paper ejecting assembly 68 and the platen paper gripping assembly 76 is controlled by a sector gear 100 having a plurality of teeth terminating at a pair of stops 102. The sector gear 100 is pivotally mounted to an axle 104, see FIG. 2, extending transversely between the side plates 34, 36 to which a pair of cable pulleys 106, 106' are attached adjacent each side plate. A single motor 108 having a drive gear 110 meshed with the teeth of the sector gear 100 causes rotation of the axle 104 and cable pulleys 106, 106' in either a clockwise or counterclockwise direction depending upon the direction of rotation of the motor. Wire cables 112, 112' are provided having a center portion thereof secured to the cable pulleys 106, 106' and having their terminal ends provided with a retaining member or ball 114 slidably captured within the openings 90, 96 of the platen arms 86, 86' and ejector arms 82, 82' as best shown in FIG. 13*a*. In addition, a spring 116 is provided within the opening 96 of the ejector arms 82, 82' through which the wire cables 112, 112' respectively pass and is arranged to be compressed by the ball 114 in a manner to be described hereinafter. A pin 118 is arranged projecting from the face of the sector gear 100 at a central portion for engagement with the actuating lever of a mechanical microswitch 120. The specific operation of the paper gripping mechanism 66 with respect to the paper ejecting assembly 68 and the platen paper gripping assembly 76 by means of rotation of the sector 100 will now be described.

Referring to FIGS. 13*a* through 13*c*, the operation of the paper gripping mechanism 66 will be described by reference only to its construction as shown adjacent side plate 34. As shown in FIG. 13*a*, the paper bail 78 is normally engaged on the outer surface of the platen 32 while the ejector roller 70 is normally spaced apart from the stationary ejector roller 72. This condition is achieved by the spring 98 biasing the ejector arm 82 away from the stationary ejector roller 72 and the spring 92 biasing the platen arm 86 towards the platen 32 for engagement with the paper bail 78. In addition, this condition is maintained by the drive gear 110 being positioned centrally along the teeth of the sector gear 100 between the stops 102. Upon rotation of the drive gear 110 in a counterclockwise direction as viewed in FIG. 13*a*, the sector gear 100 is rotated in a clockwise direction, a predetermined amount to the position adjacent the upper stop 102 as shown in FIG. 13*b*. As the sector gear 100 is rotated in the clockwise direction, the cable 112 being attached to the cable pulley 106 causes that portion of the cable captured within the opening 96 within the lower end of the ejector arm 82 to rotate the ejector arm in a counterclockwise direction causing the engagement of the ejector roller 70 with the stationary ejector roller 72. The compression spring 116 serves to accommodate any overdrive of the sector gear 100 to prevent damage to the ejector arm 82 or the components thereof. As shown in FIG. 13*b*, as the sector gear 100 is rotated in the clockwise direction, the pin 118 closes the microswitch 120 via the actuating lever which was previously in an open condition as shown in FIG. 13*a*. The function of the microswitch 120 will be described hereinafter.

Referring to FIG. 13*c* as the drive gear 110 is rotated in a clockwise direction, the sector gear 100 is rotated in a counterclockwise direction until the drive gear is positioned adjacent the lower stop 102. In this position, the cable 112 being attached to the cable pulley 106 and having its end captured within the opening 90 at the lower end of the bail arm 86, causes the bail arm to rotate in a counterclockwise direction moving the paper bail 78 away from its previous engagement with the surface of the platen 32. It is to be noted that as the ends of the cable 112 are slidingly encaptured within the openings 90, 96 of the bail arm 86 and ejector arm 82, the rotation of the sector gear 100 in a clockwise direction, although causing the ejector roller 70 to engage the stationary ejector roller 72 by pivotal movement of the ejector arm 82, the bail arm 86 is maintained in its position where the paper bail 78 is in engagement with the platen 32. Likewise, the rotation of the sector gear 100 in a counterclockwise direction to cause pivotal movement of the bail arm 86 in a counterclockwise direction to remove the paper bail 78 from engagement with the platen 32, allows the ejector arm 82 to remain in its position where the ejector roller 70 is spaced from and out of engagement with the stationary ejector roller 72.

Figure 4:
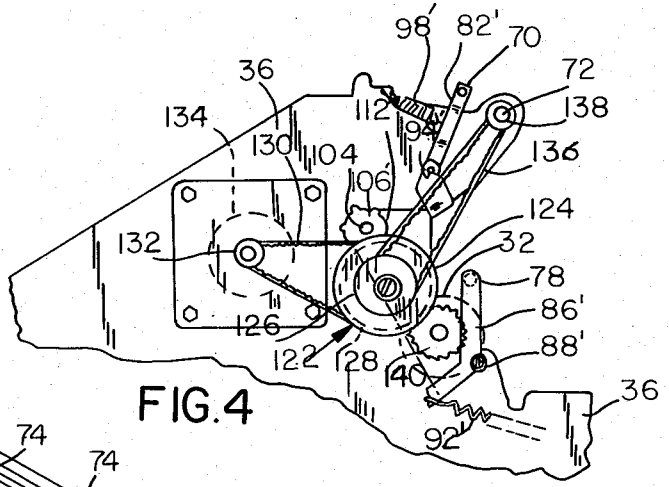
FIG. 4 is a side elevational view taken along lines 4—4 of FIG. 3 and illustrating the platen of FIG. 3 showing the platen idler gear assembly of the present invention adapted for rotation of the platen and paper ejecting means.

Referring to FIG. 4, there will now be described the platen idler gear assembly generally designated by reference character 122. The platen idler gear assembly 122 is constructed of a center gear 124 sandwiched between a forward ejector gear 126 and a rear platen gear 128, shown in dotted lines. The platen idler gear assembly 122 is rotated by a timing belt 130 driven by a pulley 132 connected to a motor 134 as shown in dotted lines, see also FIG. 2. The stationary ejector roller 72 is likewise rotated by a timing belt 136 provided between the forward ejector gear 126 and a pulley 138 secured to the ejector roller adjacent the side plate 36. The platen 32 is driven by the rear platen gear 128 being meshed with a platen drive gear 140 attached at one end thereof adjacent the side plate 36. Thus, it can be appreciated that the controlled operation of the motor 134 is such to cause simultaneous rotation of the platen 32 and the ejector roller 72.

Referring to FIGS. 5*a*, 5*b*, 6 and 7, there will now be described the paper loading assembly generally designated by reference character 142 in accordance with the present invention. The paper loading assembly 142 is constructed from a pair of side frames 144, 146 spaced apart in parallel relationship by means of a plurality of transversely extending rods 148. The side frames 144, 146 are constructed to include pairs of upper and lower inwardly facing U-shaped tracks 150, 152. As will be understood, the side frames 144, 146 are spaced by the rods 148 such that the paper trays 10, 12 can be received and supported within the pairs of tracks 150, 152 of the paper loading assembly 144. The paper loading assembly 142 is adapted to receive the paper tray 10 within the upper pairs of tracks 150, which is identical to the construction of the paper loading assembly for receiving the paper tray 12 within the lower pair of tracks 152. Accordingly, the following description will refer to that portion of the paper loading assembly 142 adapted to receive the paper tray 10 within the pairs of upper tracks 150.

As shown in FIG. 5*a*, spaced above the pair of tracks 150 at the rear end of the side frames 144, 146 there is provided a transversely extending paper feed shaft 154 having a pair of spaced apart rollers 156 secured thereto. The rollers 156 are adapted to engage spaced portions of the upper sheet of paper 14 urged into contact therwith upon insertion of the paper tray 10 between the pair of upper tracks 150 as to be described. That end of the paper feed shaft 154 adjacent the side frame 144 is connected to a gear 158 centrally provided with a one-way roller clutch 160 (see also FIG. 2). As best shown in FIG. 7, the gear 158 is driven by a drive gear 162 connected to a motor 164 operative in a clockwise and counterclockwise direction. Likewise, the lower paper feed shaft 154' is connected to a gear 158' having a one-way roller clutch 160' adapted to be driven by the drive gear 162 by means of an idler gear 166 meshed therebetween. The one-way roller clutches 160, 160' are operative so that the gears 158, 158' will be free rolling relative to the paper feed shafts 154, 154' in one direction, i.e., when the gears 158, 158' rotate in a clockwise direction relative to the paper feed shafts 154, 154' as viewed in FIG. 7, and will be locked with the paper feed shafts 154, 154' in the opposite direction, i.e., the counterclockwise direction relative to the paper feed shafts 154, 154' as viewed in FIG. 7. In this way, when the gears 158, 158' are rotated in the counterclockwise direction by operation of the motor 164, the paper feed shafts 154, 154' and the rollers 156, 156' will be rotated therewith to engage and force a single sheet of paper 14 from a respective paper tray 10, 12 forwardly thereof. On the other hand, when the gears 158, 158' stop rotating and the single sheet of paper 14 is pulled out from one of the paper trays 10, 12, either manually or by operation of the paper ejecting assembly 68, the rollers 156, 156' and paper feed shafts 154, 154' will be free to rotate in the counterclockwise direction. The operation of the motor 164 alternately between a clockwise and counterclockwise direction is operative to feed a sheet of paper 14 respectively from one of the paper trays 10, 12.

Specifically, clockwise rotation of the drive gear 162 by the motor 164 is operative to cause rotation of the gear 158 and roller clutch 160 in a counterclockwise direction causing rotation of the paper feed shaft 154 and rollers 156 in a counterclockwise direction for feeding a single sheet of paper 14 from the paper tray 10. However, the clockwise rotation of the drive gear 162 causes clockwise direction of the gear 158' and roller clutch 160' as a result of the intermeshed idler gear 166. The clockwise direction of the roller clutch 160' allows the paper feed shaft 154' and rollers 156' to remain stationary without rotation thereby enabling the feeding of single sheets of paper 14 from only the paper tray 10. Conversely, the counterclockwise rotation of the drive gear 162 by the motor 164 causes counterclockwise rotation of the gear 158' and roller clutch 160' by the intermeshed idler gear 166. The counterclockwise rotation of the roller clutch 160' causes counterclockwise rotation of the paper feed shaft 154' and rollers 156' to effect feeding of single sheets of paper 14 from the paper tray 12.

However, in a similar manner as previously described, the counterclockwise rotation of the drive gear 162 causes clockwise rotation of the gear 158 and roller clutch 160 such that the paper feed shaft 154 and rollers 156 remain idle. Thus, it can be appreciated that individual sheets of paper 14 can be fed alternatively between the paper trays 10, 12 depending upon the direction of rotation of the drive gear 162 in either a clockwise or counterclockwise direction by operation of the motor 164.

Figure 10A:
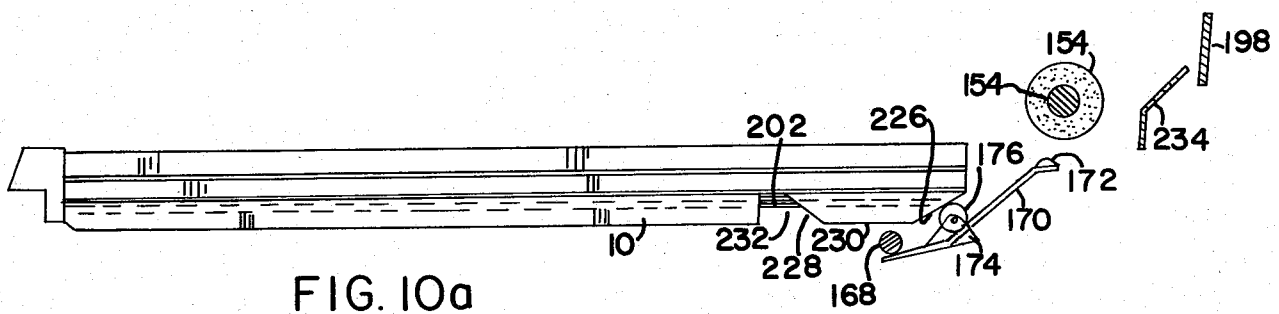
FIGS. 10*a* through 10*c* are side elevational views showing the operative engagement between the paper tray of FIG. 8 within the paper loading assembly of FIG. 5*a;*

Positioned forward of the paper feed shaft 154 and extending transversely between the side frames 144, 146 is a rotatable pressure shaft 168 having a centrally attached upwardly projecting pressure arm 170 terminating at a flat portion having a protrusion 172 thereon. Secured to the end of the pressure shaft 168 adjacent the track 150 of the side frame 144 is a bracket 174 having a cam follower or roller 176 rotatably mounted thereto as best shown in FIG. 6. The roller 176 is mounted for rotation about a horizontal axis rearward of the axis of rotation of the pressure shaft 168. Further, as best shown in FIG. 10*a*, with the pressure shaft 168 in its normal position, the vertical circumferential extent of the roller 176 extends beyond the vertical extent of the pressure shaft 168. The pressure shaft 168 is normally biased in its operative position as shown in FIG. 5*a* by means of spring 178 attached to the bracket 174 and a portion of the side frame 144. Arranged transversely extending between the side frames 144, 146 and underlying the pressure shaft 168, slightly rearward thereof, is a paper sensor arm 180 having a centrally attached probe 182. The leftmost end of the paper sensor arm 180 extends through the side frame 146 and operatively engages a microswitch 184. As to be further understood, the paper sensor arm 180 and microswitch 184 are operative to detect the presence or absence of sheets of paper 14 within the paper trays 10.

Provided within the opening 186 within the track 150 of the side frame 146 is a roller assembly 188 constructed of a bracket 190 and a roller 192 rotationally mounted about a vertical axis. The bracket 190 is pivotally mounted to the side frame 146 within the opening 186 such that the roller 192 extends into the track 150 by means of bias spring 194. A pair of spaced apart paper guide plates 196, 198 are arranged vertically extending transversely between the side frames 144, 146 to the rear of the pressure shafts 168, 168' to define a paper feed path therebetween from a lower paper tray 12, as more clearly shown in FIG. 14. The specific operation of the paper loading assembly 142 will be described hereinafter.

Figure 9:
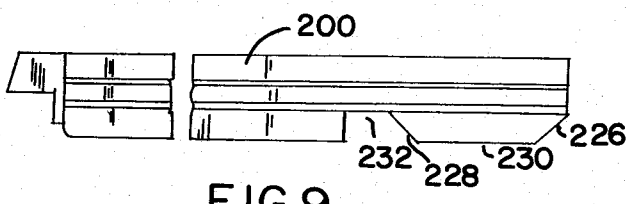
FIG. 9 is a side elevational view taken along lines 9—9 of FIG. 8 showing a leading side portion of the paper tray constructed of first, second and third cam surfaces.
Figure 8:
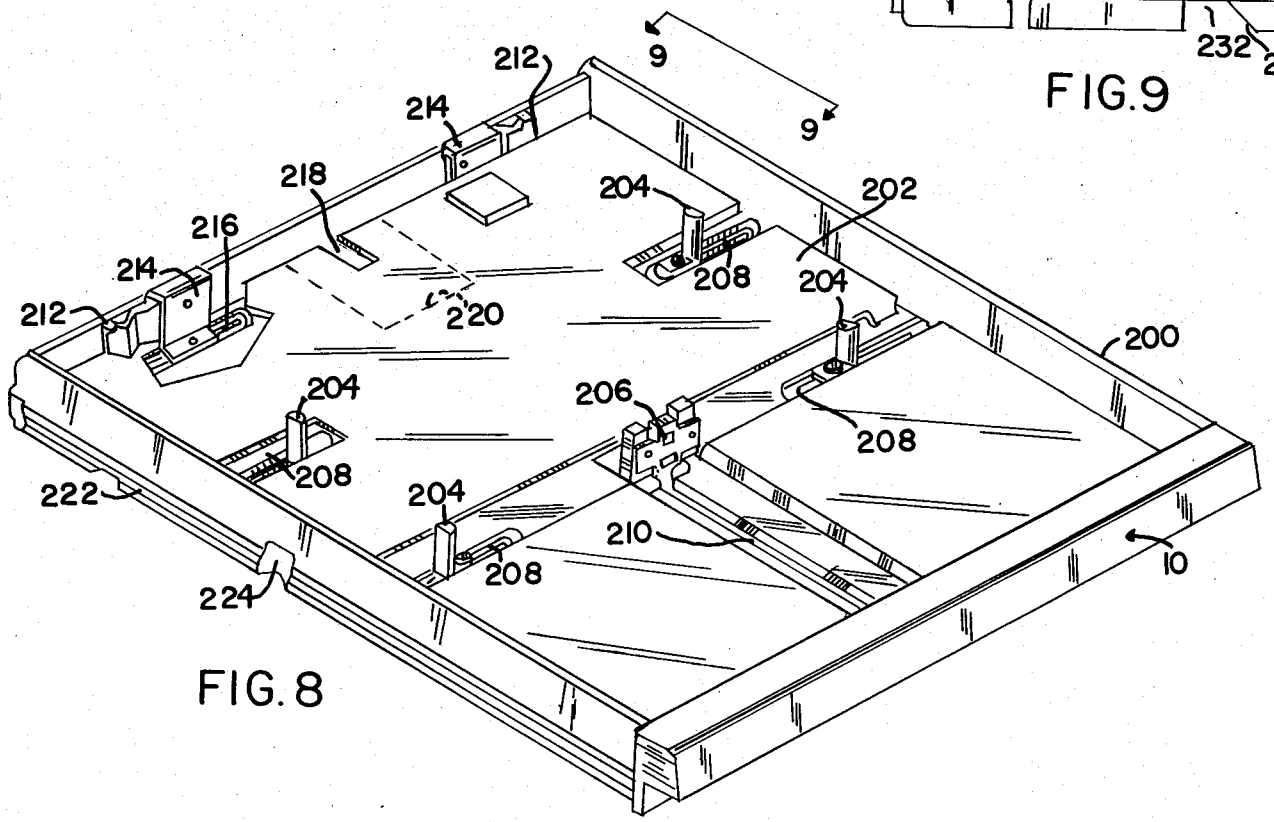
FIG. 8 is a perspective view of a paper tray in accordance with the present invention which is adapted to be inserted into the paper loading assembly as shown in FIG. 5*a;*

Turning to FIGS. 8 and 9, the construction of the paper trays 10, 12 will now be described. Initially, it is noted that the paper trays 10, 12 are of identical construction. In this regard, the paper trays 10, 12 are suitable for insertion in the paper loading assembly 142 between either the upper tracks 150 or lower tracks 152. This is further made possible by the identical construction of the paper loading assembly 142 operative for feeding of individual sheets of paper 14 from either the upper paper tray 10 or lower paper tray 12. As each of the paper trays 10, 12 is similarly constructed and supported between the side frames 144, 146 of the paper loading assembly 142, only the upper paper tray 10 and the manner of supporting same will be described.

The upper paper tray 10 comprises a tray shaped box member 200 having a paper support plate 202 pivotally supported in the bottom thereof. The dimensions of the tray shaped box member 200 are substantially greater than the dimensions of the paper 14 to be provided therein so as to accommodate sheets of paper of various widths and lengths. In this regard, the sheets of paper 14 are placed on the paper support plate 202 between a plurality of adjustable paper guides 204 and a paper stop 206. The paper guides 204 are adjustably secured within slots 208 provided in the box member 200 to accommodate various widths of sheets of paper. Likewise, the paper stop 206 is adjustably positioned within a slot 210 to accommodate various lengths of sheets of paper to be used. As shown, each of the paper guides 204 and the paper stop 206 extends substantially above the surface of the paper support plate 202 to accommodate a stack of paper sheets. Also, suitable paper retention means may be provided for normally retaining the paper 14 in the paper tray 10 such as, for example, tab members 212 arranged at the forward side edges of the paper tray 10. These tab members 212 also serve to separate the sheets of paper 14 so that a single sheet of paper at a time will be fed by the pressure shaft 168 from the paper tray 10. The tab members 212 are adjustably spaced by means of a retaining lever 214 adjustably secured within an underlying slot 216 within the box member 200.

The forward end of the paper support plate 202 is provided with an opening 218 for receiving the probe 182 of the paper sensor arm 180 to be described hereinafter. Likewise, the forward end of the box member 200 is provided with an opening 220 to receive the pressure arm 170 of the pressure shaft 168 as to be described hereinafter. The left lateral edge of the box member 200 is provided with a longitudinally extending track 222 adapted to engage the roller 192 of the roller assembly 188 and a notch 224 positioned along the track for capturing the roller as to be described hereinafter. Referring to FIG. 9, there is shown the construction of the underlying portion of the forward end of the right lateral side of the box member 200. The forward end of the box member 200 is provided with a first sloped cam surface 226 and a second sloped cam surface 228 spaced apart by means of a horizontal cam surface 230. The second cam surface 228 extends into an opening 232 adapted to receive the roller assembly 174 during installation of the paper tray 10 within the paper loading assembly 142.

Figure 10B:
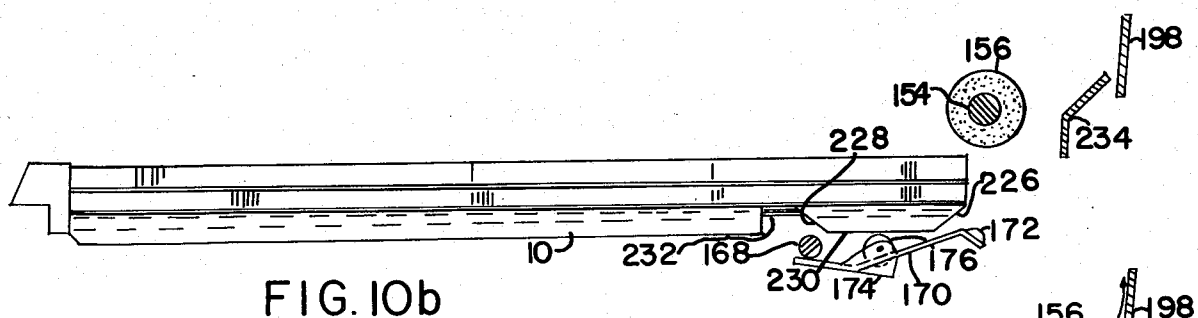
Figure 10C:
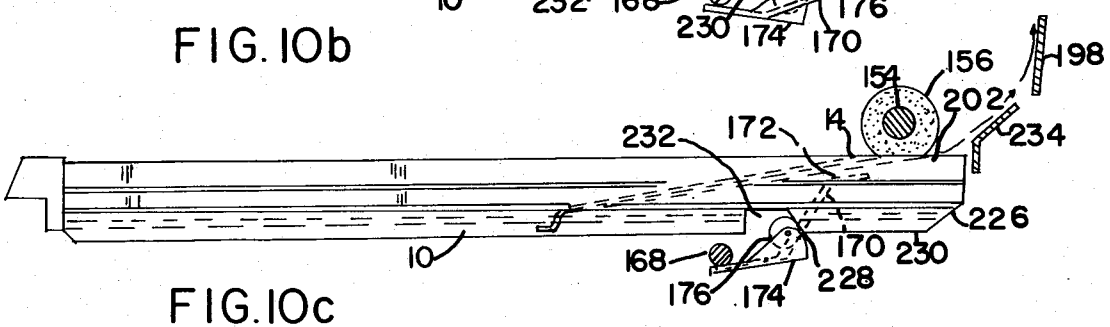

There will now be described the manner in which the paper trays 10, 12 are inserted into the paper loading assembly 142 with specific reference to FIGS. 10*a*–10*c*. Initially, a stack of sheets of paper 14 are positioned overlying the paper support plate 202 between the paper guides 204 and paper stop 206. The leading edge of the top sheet of paper 14 is positioned underlying the tab member 212 with the leading edge of the stack overlying the opening 218 within the paper support plate 202. The longitudinal center axis of the stack of paper 14 is now in alignment with the longitudinal center axis of the paper tray 10. The leading end of the paper tray 10 is inserted into the paper loading assembly 142 such that the sides of the paper tray are received within the tracks 150. As the paper tray 10 moves into the paper loading assembly 142, the roller 192 of the roller assembly 188 engages the track 222 provided on the left side of the paper tray. This engagement of the roller 192 with the track 222 urges the paper tray 10 towards the side frame 144 to ensure precise and repeated alignment of the paper 14 with the printing device 26 as the paper is fed from the tray 10. The extent to which the paper tray 10 may be inserted into the paper loading assembly 142 is limited by stops (not shown) on the side frame. In this regard, as the paper tray 10 is inserted within the paper loading assembly 142, the roller 192 rolls along the track 222 until it is captured within the notch 224, thereby detecting the tray 10 in its forward-most position and biasing the tray 10 toward the right side frame.

Thus, it can be appreciated that the position of the paper tray 10 within the paper loading assembly 142 is accurately repeatable thereby centering the paper with respect to the platen 32 to effect thereon by the printing device 26.

As shown in FIG. 10*a*, as the paper tray 10 is inserted into the paper loading assembly 142, the roller 176 attached to the bracket 174 of the pressure shaft 168 engages the first cam surface 226. The engagement of the roll 176 with the first cam surface 226 causes rotation of the pressure shaft 168 in a clockwise direction to pivot the pressure arm 170 away from interference with the leading edge of the paper tray 10. As shown in FIG. 10*b*, as the roller 176 engages the horizontal cam surface 230, the pressure arm 170 has been rotated to a position where the protrusion 172 of the pressure arm 170 is generally underlying the bottom of the paper tray 10. With the pressure arm 170 in the position illustrated in FIG. 10*b*, the paper tray 10 may be further inserted into the paper loading assembly 142 without interference from the pressure arm. Finally, as shown in FIG. 10*c*, as the roller 176 engages the second cam surface 228, the pressure arm 170 is rotated in a counterclockwise direction through the opening 220 provided in the bottom of the paper tray 10 so as to engage the leading edge of the paper support plate 220 by the protrusion 172. As the roller 176 is finally captured within the opening 232 adjacent the second cam surface 228, the pressure arm 170 is operative to pivot the paper support plate 202 upwardly to raise the forward edges of the sheets of paper 14 to be at or just above the forward end of the paper tray 10 and in contact with the rollers 156 for feeding individual sheets of paper therefrom along a paper feed path to the platen 32 to be printed thereon by the printing device 26. As shown, the leading end of the sheets of paper 14 are positioned adjacent a paper deflector plate 234 to deflect the paper fed from the paper tray 10 along the paper feed path formed between the paper guide plates 196, 198.

As should now be apparent, the paper tray 10 may be removed from the paper loading assembly 142 by reversing the above procedure. Specifically, as the paper tray 10 is withdrawn from the paper loading assembly 142, the roller 176 engages the second cam surface 228 to cause pivotal movement of the pressure arm 170 in a clockwise direction out of engagement with the paper support plate 202. When the roller 176 is engaged with the horizontal cam surface 230, as shown in FIG. 10*b*, the pressure arm 170 has been rotated outside the opening 220 of the tray 10 to permit removal of the paper tray from the paper loading assembly 142 with the roller 192 of the roller assembly 188 being urged out of the notch 224 and being guided along the track 222.

The paper loading assembly 142, as previously described, includes paper sensor arms 180, 180' for sensing when the paper trays 10, 12 are out of paper. The paper sensor arms 180, 180', one for the upper tray 10 and one for the lower tray 12, each include a probe 182, 182' which is directed towards its respective paper tray 10, 12 and engages a sheet of paper 14 when paper is in the paper trays. The paper support plate 202 in the paper trays 10, 12 are each provided with an opening 218 therein in alignment with the probe 182, 182' of the respective paper sensor arms 180, 180'. The microswitches 184, 184' are respectively operatively connected to the paper sensor arms 180, 180' and are opened when the probes 182, 182' are raised and are closed when the probes are lowered, the probes being generally biased towards the lowered position. As long a sheet of paper 14 is in the paper trays 10, 12 on top of the paper support plate 202 which is biased upwardly by the pressure arms 170, 170' the probes 182, 182' will be in the raised position thereby opening the microswitches 184, 184'. However, when the last sheet of paper 14 is removed from the paper tray 10 or 12 or when the paper tray is removed from the paper loading assembly 142, there will be no sheet of paper or other means for maintaining the probes 182, 182' in the raised position and the microswitches 184, 184' will thus move into its lower position, thereby providing an indication that no paper is available for feeding to the printing device 26.

Figure 12:
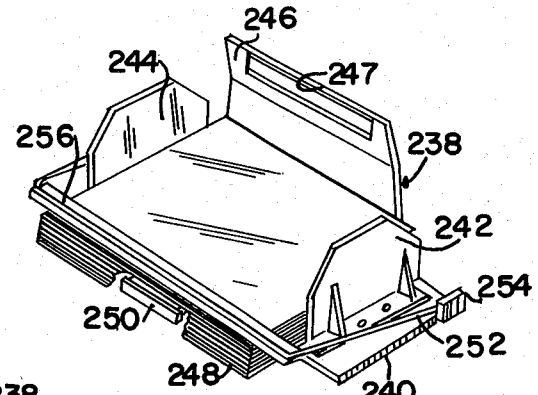
FIG. 12 is a perspective view of an envelope tray adapted for use in the envelope loading assembly as shown in FIG. 11.
Figure 11:
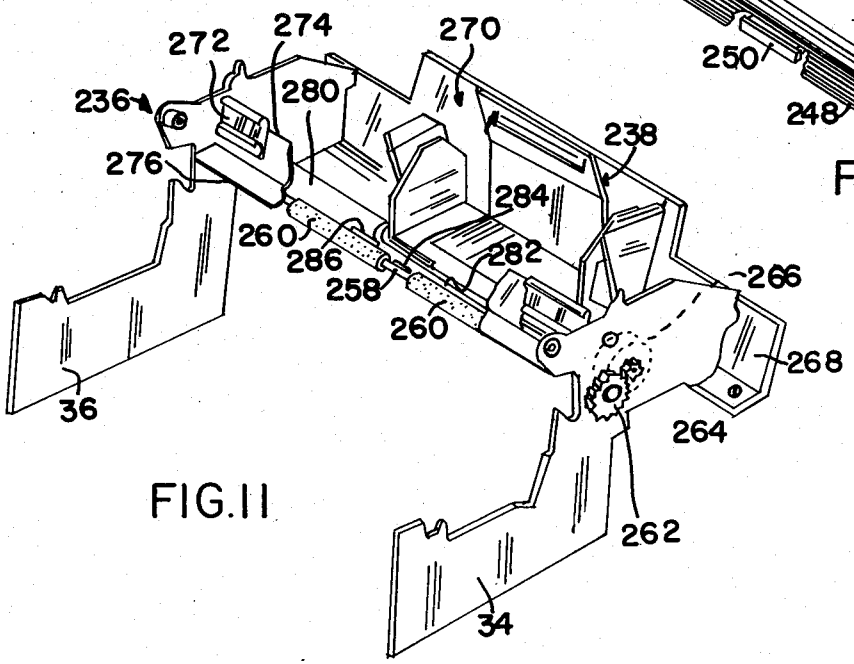
FIG. 11 is a perspective view of the envelope loading assembly in accordance with the present invention showing various components thereof.

Referring to FIGS. 11 and 12, the construction of the envelope feeding assembly or envelope stripper mechanism 236 and envelope tray 238 will now be described. Specifically with reference to FIG. 12, the envelope tray 238 is constructed from an envelope support plate 240 having a pair of spaced apart adjustable upstanding sidewalls 242, 244 and an upstanding rear wall 246 providing with an opening 247 to act as a handle for the envelope tray. A stack of envelopes 248 are supported by the envelope support plate 240 between the sidewalls 242, 244 which may be adjustable by suitable means such as slots provided within the envelope support plate in a similar manner to that previously described with respect to the paper trays 10, 12. The width of the paper support plate 240 is generally smaller than the width of the stack of envelopes 248. In this regard, the leading edge of the envelopes 248 overhangs the extent of the envelope support plate 240 as shown in FIG. 12. This overhanging portion of the envelopes 248 is centrally supported by a projection 250 extending outwardly from the envelope support plate 240. A U-shaped arm 252 is pivotally supported at its terminal ends by a block member 254 mounted to the rear corners of the envelope support plate 240. The front section of the arm 252 is aligned overlying the overhanging portion of the envelopes 248 and is provided with a weight 256 adapted to press the overhanging portion downwardly against the projection 250.

As shown in FIG. 11, the envelope stripper mechanism 236 includes an envelope feed shaft 258 transversely extending between the side plates 34, 36 and having a pair of spaced apart rollers 260 adapted for engagement with an envelope 248 within the envelope tray 238. The envelope feed shaft 258 is rotated by an envelope drive gear 262 meshed with drive gear 264 connected to a motor 266 adjacent the side plate 34. As shown in FIG. 14, the envelope feed shaft 258 is positioned underlying and rearward of the platen 32. A frame member 269 is provided transversely extending across the rear of the side plates 34, 36 to provide a well 270 between the frame member and the envelope feed shaft 258 adapted to receive the envelope tray 238 having a stack of envelopes 248 therein. As to be described with reference to FIG. 14, when the envelope tray 238 is placed within the well 270, the overhanging portion of the lowermost envelope 248 within the envelope tray is engaged by the rollers 260 of the envelope feed shaft 258. It can be appreciated that the rotation of the rollers 260 by the envelope feed shaft 258 is operative to withdraw the lowermost envelope 248 from the envelope tray 238 and to feed same along an envelope feed path to the platen 32. Also, it should be noted that as with the feeding mechanisms for the paper trays 10, 12, the envelope drive gear 262 is provided with a one-way roller clutch for uncoupling the envelope feed shaft 258 from rotation with the drive gear 262 so as to permit envelopes to be pulled from the envelope tray 238 by the platen 32, without interference from the envelope feed rollers 260, after an envelope has driven into engagement with the platen 32.

Forward of the envelope feed shaft 258 and transversely extending between the side plates 34, 36 is provided a pair of spaced apart paper guide plates 272, 274 defining a manual paper feed path therebetween in alignment with the rear portion of the platen 32. The lowermost portion of the paper guide plate 274 is provided with a generally horizontally extending stripping member 276 lying along one side of the envelope feed path with the rollers 260 of the envelope feed shaft 258 lying on the opposite side thereof. The envelope stripping member 276 is constructed of such material as natural rubbers and synthetic compounds such as urethane having a high coefficient of friction and, wherein the coefficient of friction between the stripping member and the envelope is greater than the coefficient of friction between two adjacent envelopes. The specific operation of the envelope stripping mechanism will be described hereinafter. Underlying the envelope feed shaft 258 and transversely extending between the side plates 34, 36 is a paper guide 280 adapted for supporting a lever actuated envelope microswitch 282, an envelope sensor 284 and a paper sensor 286. The envelope microswitch 282 is adapted to sense when the envelope tray 238 is out of envelopes. The lever of the envelope microswitch 282 engages the lowermost envelope 248 when an envelope is in the envelope tray 238 and the envelope tray is positioned within the well 270 as shown in FIG. 11. The envelope microswitch 282 is open in the absence of envelopes and closed when envelopes are present. As long as an envelope 248 is in the envelope tray 238 within the well 270 on top of the rollers 260 of the envelope feed shaft 268, the envelope microswitch 282 will be in the closed position. However, when the last envelope 248 is removed from the envelope tray 238, or when the envelope tray is removed from the well 270, there will be no envelope or other means for maintaining the envelope microswitch 282 in the closed position and will thus move into its open position, thereby providing an indication that no envelope 248 is available for feeding to the printing device 26.

Each of the sensors 62, 284, 286 are of the phototelectric reflective type which transmits a beam of light and which includes means for receiving the reflected light to close the sensors. Thus, when a sheet of paper 14 is moved in front of each of the sensors 62, 284, 286, the paper will serve to reflect and direct the projected light back to the sensors which detect same and closes the sensors indicating the presence of a sheet of paper. The paper sensor 286 is mounted in the lower end of the paper guide plate 280 facing towards the paper feed path formed between the paper guide plate 280 and spaced apart adjacent underlying paper guide plate 288. This sensor 286 serves to detect if and when a sheet of paper 14 is moved therepast in order to signal the actuation of the platen 32 for rotation to receive a sheet of paper fed from one of the paper trays 10, 12. Similarly, the envelope sensor 284 is attached to the paper guide plate 280 facing upward toward the envelope feed path adjacent the rollers 260 of the envelope feed shaft 258. This sensor 284 also serves to detect if and when an envelope 248 is moved therepast in order to signal the actuation of the platen 32 for rotation to receive an envelope feed from the envelope tray 238. The print head carriage assembly sensor 62 is located on top of the ribbon carriage 42 facing the platen 32 along the exit path of movement of a sheet of paper 14, or envelope 248, for detecting when a sheet of paper or envelope has been picked up by the platen and is being moved thereby along the paper exit path. This sensor 62 also serves to provide a reference point used in positioning of the print wheel 44 in a proper printing position relative to the paper 14. In this regard, the sensor 62 detects the leading edge, as well as the left edge, of a sheet of paper 14 or envelope 258 as it is fed to the platen 32 from a paper tray 10, 12 or envelope trays 238. Thus, the print wheel 44 may be positioned in proper alignment for typing on a sheet of paper 14 or envelope 248 having a predetermined top and left side margin. Further, the sensor 62 may be used to detect the bottom edge of a sheet of paper for determining the length of such sheet to ensure that the controls for the printing device have been preset for the proper size of paper contained within the printing trays 10, 12 or the size of the envelope 248 provided within the envelope tray 238.

The integrated printer and paper feeding apparatus 2 of the present invention has now been described with respect to its construction, as well as generally to its operation. The controlled operation of the integrated printer and paper feeding apparatus 2 will be performed by a computer or microprocessor contained within the housing 4 as is generally known to those skilled in the art. In this regard, the integrated printer and paper feeding apparatus 2 of the present invention may be programmed to operate by such a microprocessor in a variety of ways. For example, the method of operation of the integrated printer and paper feeding apparatus 2 of the present invention may be generally in accord with that disclosed in the foregoing U.S. Pat. No. 4,326,815, the subject matter of such patent being incorporated herein by reference. With this in mind, a brief description of the operation of integrated printer and paper feeding apparatus 2 in accordance with the preferred embodiment of the present invention will now be described.

Specifically referring to FIG. 14, a stack of sheets of paper 14 is positioned overlying the paper support plate 202 of the upper paper plate 10 and the lower paper plate 12. The uppermost sheet of each stack of paper 14 along the forward edge thereof is engaged under the tab members 212 as shown in FIG. 8. The paper trays 10, 12 are inserted into the paper loading assembly 142 between the tracks 150, 152 as previously described until the pressure arms 170, 170' tilt the paper support plates 202 to cause the upper sheets of paper 14 to be engaged by the rollers 156, 156' of the paper feed shafts 154, 154'. This is achieved by the roller 176 as shown in FIG. 6 engaging the first, second and horizontal cam surfaces 226, 228, 230 of the paper trays 10, 12. As shown in FIG. 14, the leading ends of the sheets of paper 14 within the paper trays 10, 12 are in alignment with the paper feed paths leading to the platen 32. For example, the sheets of paper 14 in the lower paper tray 12 are adjacent the paper deflector plate 234 for deflecting a sheet of paper fed therefrom along the paper feed path defined between the paper guide plates 196, 198. Likewise, the topmost sheet of paper 14 within the upper paper tray 10 is in alignment with the paper guide plate 196 for deflecting the sheet of paper fed therefrom along the paper feed path defined between the paper guide plates 280, 288 to the platen 32.

Where envelopes are desired to be printed upon, a stack of envelopes 248 are provided overlying the envelope support plate 240 and the weight 256 attached to the U-shaped arm 252 is positioned overlying the top envelope adjacent the leading edge of the stack of envelopes as they overhang the extent of the envelope support plate. The envelope tray 238 is inserted into the well 270 such that the overhanging edge of the bottom envelope engages the top circumferential surface of the rollers 260 of the envelope feed shaft 258. The leading edge of the envelopes 248 are positioned generally adjacent the rear surface of the paper guide plate 274. The bottom envelope 248 is now in line with the envelope feed path from the envelope tray 238 to the platen 32. As apparent, as envelopes 248 are fed from the bottom of the stack within the envelope tray 238, the weight 256 pivots downward by means of the U-shaped arm 252 to maintain a constant pressure on the lowermost envelope against the rollers 260 of the envelope feed shaft 258 for feeding same along the envelope feed path to the platen 32.

After the paper trays 10, 12 and envelope tray 238 are loaded into the integrated printer and paper feeding apparatus 2, the apparatus is powered up. At this time, the control panel 24 is used to control the functions of the integrated printer and paper feeding apparatus 2 in accordance with the present invention by means of a suitably programmed microprocessor or computer. In accordance with one embodiment, after powering up the integrated printer and paper feeding apparatus 2, the sector gear 100 is rotated in a clockwise direction by the drive gear 110 to cause engagement of the ejector roller 70 with the stationary ejector roller 72 for ejecting any paper 14 within the apparatus into the paper stacking tray 16. As the sector gear 100 rotates in the clockwise direction, the microswitch 120 is actuated by engagement of its lever with pin 118. The actuation of the microswitch 120 causes the sector gear 100 to be rotated in a counterclockwise direction by the drive gear 100 to its normal position as shown in FIG. 13*a* after any paper 14 has been ejected from the integrated printer and the paper feeding apparatus 2. Individual sheets of paper 14 are fed from one of the paper trays 10, 12 by rotation of the drive gear 162 (see FIG. 7) in either a clockwise or counterclockwise direction. As a sheet of paper 14 passes the paper sensor 286, the platen 32 is rotated after a short programmed time delay. When the print head carriage assembly sensor 62 the detects the leading edge of a sheet of paper 14, the sector gear 100 is rotated in a counterclockwise direction to disengage the paper bail 78 from engagement with the surface of the platen 32. The platen 32 is subsequently rotated a predetermined number of steps such that the leading edge of the sheet of paper 14 is positioned underlying the paper bail 78 and the sector gear 100 is rotated in the clockwise direction to cause the paper bail 78 to engage the platen 32 and secure the sheet of paper therebetween. The print head carriage assembly sensor 62 then detects the left edge of the sheet of paper and positions the print wheel 44 in its proper position for the start of typing to effect printing on the paper.

As the printing is effected on the paper 14, line-by-line, the platen 32 is indexed to roll the sheet of paper upward to accommodate the next line of printing. The printed sheet of paper follows along the paper exit path and is guided by the exit guide plate 84 towards the ejector roller 70 and stationary ejector roller 72. Upon receipt of an eject command or the detection of the trailing edge of a sheet of paper 14 by the print head carriage assembly sensor 62, the sector gear 100 is rotated by the drive gear 110 in a clockwise direction to cause the engagement of the ejector roller 70 with the stationary ejector roller 72 for ejecting the printed sheet of paper from therebetween and into the paper stacking tray 16. After the ejection of a sheet of paper 14 from the printing device 26, the sector gear 100 is rotated back to its normal position as shown in FIG. 13*a*. It is to be noted that the platen 32 is operative to smoothly advance a sheet of paper 14 along the paper feed pat although the trailing edge of such paper is still engaged by the rollers 156, 156' of the paper feed shaft 154, 154'. This is achieved by the construction of the gears 158, 158' to include the roller clutch 160, 160' as previously described.

A further feature of the present invention is the provision of a manual paper feed path defined between the guide plates 272, 274 positioned upstanding behind the exit guide plate 84. The manual paper feed path is provided for the manual feeding of sheets of paper, envelopes, index cards and the like to the printing device 26 by engagement of same between the platen 32 and the pressure rollers 40 and 40'. The platen 32 can be manually indexed in a forward or reverse direction by use of the control panel 24 to effect feeding of such sheets of paper, envelopes, index cards and the like to the printing device 26. The integrated printer and paper feeding apparatus 2 permits the automatic or manual loading of sheets of paper 14 into the printing device 26 for printing thereon either from commands located in the text being processed or by operator selection through the control panel 24. Thus, in this latter regard, the integrated printer and paper feeding apparatus 2 may be used to feed individual sheets 14 of paper automatically to the printing device 26 and print any previously created text that is stored on a disk or in the word processing unit without any additional commands for controlling the operation of the apparatus.

As thus far described, at the paper receiving portion of the printing device 26, the paper 14 is guided between the platen 32 and the paper guide 38 having a plurality of pressure rollers 40 so that upon rotation of the platen, the paper will be advanced about the platen and move past the print wheel 44 so as to be in position for effecting printing thereon by movement of the print wheel transversely across the platen and by rotation of the platen to advance the paper for different lines of printing. In this regard, it will be noted that the paper 14 is positively fed by the rollers 156, 156' from the associated paper tray 10, 12 along the paper feed path to be received and moved by the platen 32. Once the paper 14 is received by the platen 32, the rotation of the paper feed shaft 154, 154' is stopped and the roller clutch 160, 160' in the gears 158, 158' allows the platen 32 to easily pull the paper from the paper tray 10, 12 to advance the paper past the print wheel 44 and the printing device 26. In this regard, once the paper 14 is in the print position for printing, the platen 32 may be advanced and moved in accordance with the normal printing instructions or commands for the printing device 26 for effecting printing on the paper. As to be further understood, it will be appreciated that during the printing operation, the trailing edge of the paper 14, which in some instances may be in the paper feed path, is free to move back and forth along this path without interference from the paper trays 10, 12 or rollers 156, 156' of the paper feed shafts 154, 154'. This is a most important feature, since in impact type printing operations, the paper 14 must be capable of moving back and forth by the platen 32 for the printing of subscripts, superscripts, charts or other special operations. Also, with the integrated printer and paper feeding apparatus 2, the paper 14 is moved backwards to align the leading edge with the print head carriage assembly sensor 62 and then further to sense the desired top margin.

As further shown in FIG. 14, the envelope tray 238 is positioned within the well 270 to the right of the guide plate 274 such that the leading edge of the lowermost envelope 248 is maintained in engagement with the rollers 260 of the envelope feed shaft 258. A constant pressing force is applied to the top of the stack of envelopes 248 by the weight 256 to insure positive engagement between the lowermost envelope 248 and the rollers 260. Activation of the motor 266 causes rotation of the rollers 260 in a counterclockwise direction to feed the bottommost envelope 248 from the stack thereof along the envelope feed path to the platen 32. When the lowermost envelope 248 is fed from the stack thereof within the envelope tray 238, there is a tendency for the two lowermost envelopes to be pulled outward from the stack by the rollers 260. If this should occur, the topmost envelope 248 will be engaged by the stripping member 276 positioned adjacent the envelope feed path on the opposite side of the rollers 260. As the topmost envelope is engaged by the stripping member 276, the coefficient of friction between the stripping member and the envelope is greater than the coefficient of friction between the upper envelope and the lower envelope. As a result of this greater coefficient of friction, the rollers 260 of the envelope feed shaft 258 are operative to continue the movement of the lowermost envelope 248 along the envelope feed path while the upper envelope is retained by the stripping member 276. After the lowermost envelope 248 is fed along the envelope feed path to the platen 32, the upper envelope now is in engagement with the stripping member 276 and may be fed upon actuation of the rollers 260 in a manner as thus far described. Thus, the stripping member 276 prevents the inadvertent feeding of two envelopes 248 to the platen 32 along the envelope feed path upon rotation of the rollers 260 by the envelope feed shaft 258. As the envelopes 248 are fed from the envelope tray 238, the weight 256 is continuously rotated downward by means of the U-shaped arm 252 thereby insuring positive engagement of the lowermost envelope with the rollers 260.

As thus far described, the apparatus of the present invention is enclosed within a simple housing having sound reducing material provided to reduce the operational noise of the apparatus. The housing is designed to provide openings to conveniently receive the paper trays and envelope tray without having to remove the housing, as well as providing a top liftable cover for easy access to the components of the apparatus without having to remove the housing.

Although the invention herein has been described with reference to particular embodiments, it is to be understood that these embodiments are merely illustrative of the principles and application of the present invention. It is therefore to be understood that numerous modifications may be made in the illustrative embodiments in that other arrangements may be devised without departing from the spirit and scope of the present invention as defined by the appended claims.

What is claimed is:

1. An integrated printer and paper feeding apparatus comprising:

a housing providing a sound-proofing enclosure for sheets of paper to be moved along a paper path which extends from a paper supply station past a printing station to a paper retrieval station, said paper supply station, said printing station and said paper retrieval station being located interiorly of said housing;

said housing including a paper supply opening therein adjacent said paper supply station for providing access to said paper supply station, and a paper retrieval opening provided in said housing adjacent said paper retrieval station for providing access to said paper retrieval station, said paper supply opening and said paper retrieval opening being provided at spaced locations from one another in said housing, and said housing being constructed to provide a substantially closed enclosure, except for said paper supply opening and said paper retrieval opening, for sheets of paper moved along said paper path to thereby minimize sound eminating from within said housing during operation of the integrated printer and paper feeding apparatus;

said housing further including an operable paper retrieval cover member adjacent said paper retrieval opening, said paper retrieval cover member being operative to substantially close said paper retrieval opening in said housing, and being openable to provide access to said paper retrieval station for removing sheets of paper therefrom;

paper storing means for storing a plurality of individual sheets of paper, said paper storing means being removably insertable through said paper supply opening in said housing for mounting said paper storing means within said housing at said paper supply station so that said individual sheets of paper stored in said paper storing means are completely contained within said housing, said paper storing means including supply opening closing means arranged thereon for closing said paper supply opening of said housing when said paper storing means is inserted through said paper supply opening and mounted within said housing;

paper feeding means arranged within said housing at said paper supply station for feeding individual sheets of paper along said paper path from said paper supply means toward said printing station when said paper supply means is inserted through and mounted within said housing;

printing means arranged at said printing station within said housing for printing on a sheet of paper;

paper advancing means arranged within said housing along said paper path for advancing a sheet of paper fed by said paper feeding means past said printing means to effect printing thereon and for thereafter advancing said sheet of paper after printing has been effected thereon along said paper path toward said paper retrieval station within said housing;

paper receptacle means arranged at said paper retrieval station within said housing for receiving and storing sheets of paper advanced by said paper advancing means from said printing means;

said housing including a first housing part and second housing part, said first housng part having said paper supply opening therein and having said paper feeding means and said printing means contained interiorly therewithin, and said second housing part having said paper retrieval opening therein and having said paper receptacle means contained therewithin, and said second housing part further being openable with respect to said first housing part to provide access to the interior of said first housing part; and control means for controlling the operation of said paper feeding means, said printing means and said paper advancing means whereby said housing together with said supply opening closing means on said paper storing means and said openable paper retrieval cover member provide a substantially closed enclosure for said paper feeding means, said printing means and said paper advancing means and for said individual sheets of paper before, during and after printing is effected thereon to minimize sound eminating from within said housing during operation of said printing and paper feeding apparatus.

2. The integrated printer and paper feeding apparatus of claim 1 further including a manual paper feed path for manually feeding individual sheets of paper from a supply external to said housing to said paper advancing means.

3. The integrated printer and paper feeding apparatus of claim 1 further including an envelope feed path for feeding individual envelopes from a supply of said envelopes within said housing to said paper advancing means.

4. The integrated printer and paper paper feeding apparatus of claim 1 further including paper gripping mechanism for engaging paper being moved through said apparatus, said paper gripping mechanism including paper gripping means arranged adjacent said paper advancing means and movable between a first position in which a sheet of paper is gripped between said paper gripping means and said paper advancing means and a second position in which said paper gripping means is spaced from said paper advancing means; a first member and a second member positioned along an exit portion of said paper path, said exit portion of said paper path extending between said printing station and said paper retrieval station, and said first member being movable between a first position in which said first member is spaced from said second member and a second position in which a sheet of paper is gripped between said first and second members; paper gripping controlling means for controlling the movement of said paper gripping means and said first member between said respective first and second positions, said paper gripping controlling means being movable in a first direction and a second direction; and connecting means for coupling said paper gripping means and said first member to said paper gripping controlling means so that said paper gripping means moves from said first position toward said second position when said paper gripping controlling means is moved in said first direction, and so that said first member moves from said first position toward said second position when said paper gripping control means is moved in said second direction.

5. The integrated printer and paper feeding apparatus of claim 4 wherein said paper gripping means pivots from said first position toward said second position while said first member remains in said first position when said paper gripping controlling means is moved in said first direction.

6. The integrated printer and paper feeding apparatus of claim 4 wherein said first member pivots from said first position toward said second position while said paper gripping means remains in said first position when said paper gripping controlling means is moved in said second direction.

7. The integrated printer and paper feeding apparatus of claim 4 further including rotating means for rotating said paper gripping controlling means alternatively between said first direction and said second direction.

8. The integrated printer and paper feeding apparatus of claim 4 further including a pulley attached to said paper gripping controlling means for securing said connecting means to said paper gripping controlling means.

9. The integrated printer and paper feeding apparatus of claim 4 further including sensing means for sensing the movement of said paper gripping controlling means in said second direction wherein said first member moves from said first toward said second position.

10. The integrated printer and paper feeding apparatus of claim 4 further including spring biasing means for biasing said paper gripping means towards said first position into engagement with said paper advancing means.

11. The integrated printer and paper feeding apparatus of claim 4 further including spring biasing means for biasing said first member towards said first position spaced adjacent said second member.

12. The integrated printer and paper feeding apparatus of claim 4 wherein said paper gripping controlling means comprises a sector gear having first and second terminal ends and journaled within said housing.

13. The integrated printer and pape feeding apparatus of claim 12 wherein said sector gear includes a stop member at said first and second terminal ends.

14. The integrated printer and paper feeding apparatus of claim 4 wherein said connecting means comprises a cable having a center portion secured to said paper gripping controlling means.

15. The integrated printer and paper feeding apparatus of claim 14 wherein said cable includes a retaining member secured at the terminal ends of said cable.

16. The integrated printer and paper feeding apparatus of claim 15 further including an arm having a portion pivotally mounted within said housing, said arm having said paper gripping means attached at one end thereof and said retaining member slidingly captured within an opening provided within the other end of said arm.

17. The integrated printer and paper feeding apparatus of claim 15 further including an arm having a portion pivotally mounted within said housing, said arm having said first member attached at one end thereof and said retaining member slidingly captured within an opening provided within the other end of said arm.

18. The integrated printer and paper feeding apparatus of claim 17 further including a spring contained within said opening through which said cable passes and arranged to be compressed by said retaining member when said paper gripping controlling means is moved in said second direction to pivot said first member from said first to said second position into engagement with said second member.

19. The integrated printer and paper feeding apparatus of claim 4 wherein said paper gripping controlling means further includes a motor for the simultaneous rotation of said paper gripping means and said second member.

20. The integrated printer and paper feeding apparatus of claim 1 further including envelope storing means for storing a plurality of individual envelopes in a stack and envelope feeding means for feeding individual envelopes from said stack to said paper advancing means along an envelope feed path, said envelope feeding means arranged along one said of said envelope feed path for engagement with a first envelope within said stack.

21. The integrated printer and paper feeding apparatus of claim 20 further including an envelope stripper for the individual stripping of envelopes from said envelope storing means, said envelope stripper comprising envelope stripping means arranged along the other side of said envelope within said stack and retaining said second envelope while permitting said first envelope to be fed from said stack to said paper advancing means by operation of said envelope feeding means.

22. The integrated printer and paper feeding apparatus of claim 21 wherein said envelope storing means comprises an envelope support plate terminating adjacent the leading end of said stack of envelopes to define a strip therebetween and a weight overlying said strip.

23. The integrated printer and paper feeding apparatus of claim 22 wherein said envelope feeding means is arranged underlying said strip and adjacent said envelope support plate, wherein said leading end of said stack of envelopes is pressed into engagement with said envelope feeding means by said weight.

24. The integrated printer and paper feeding apparatus of claim 21 wherein said envelope feeding means comprises a roller arranged transversely extending and underlying the leading end of said stack of envelopes within said envelope storing means.

25. The integrated printer and paper feeding apparatus of claim 21 wherein said envelope stripping means comprises a member transversely extending across the leading end of said envelopes within said stack.

26. The integrated printer and paper feeding apparatus of claim 25 wherein said member is arranged to include a portion extending into said envelope feed path for engagement with an envelope being fed from said envelope storing means along said envelope feed path.

27. The integrated printer and paper feeding apparatus of claim 26 wherein the coefficient of friction between said member and an envelope is greater than the coefficient of friction between two overlying envelopes.

28. The integrated printer and paper feeding apparatus of claim 1 wherein said paper supply opening comprises a first paper supply opening; wherein said paper storing means comprises a first paper tray having a plurality of individual sheets therein; and wherein said paper feeding means comprises first paper feeding means for engagement with said sheets of paper within said first paper tray, said first paper tray being arranged within said housing underlying said first paper feeding means.

29. The integrated printer and paper feeding apparatus of claim 28 wherein said housing includes a second paper supply opening; and further including a second paper tray having a plurality of individual sheets of paper therein and second paper feeding means for feeding individual sheets of paper from said second paper tray along said paper path, said second paper tray being removably insertable through said second paper supply opening for mounting within said housing spaced from said first paper tray within said housing so that said sheets of paper stored in said second paper tray are completely contained within said housing, and said second paper tray being arranged underlying said second paper feeding means for engagement of said second paper feeding means with said sheets of paper within said second paper tray.

30. The integrated printer and paper feeding apparatus of claim 29 wherein said first and second paper feeding means comprise guide means for defining the portion of said paper path between said paper storing means and said paper advancing means, and first and second transversely spaced feed rollers for feeding a sheet of paper respectively from said first and second paper trays along said paper path to said paper advancing means.

31. The integrated printer and paper feeding apparatus of claim 30 wherein said control means comprises a driver gear operatively coupled to said first feed roller through a first clutch, said first clutch operable upon rotation in one direction, and operatively coupled to said second feed roller through an idler gear and a second clutch, said second clutch operable upon rotation in said one direction.

32. The integrated printer and paper feeding apparatus of claim 31 wherein said control means further includes a motor for rotation of said drive gear in a forward direction to effect rotation of said first clutch in said one direction and in an opposite direction to effect rotation of said second clutch in said one direction, whereby said first and second feed rollers are respectively rotated.

33. The integrated printer and paper feeding apparatus of claim 1 further including paper sensing means arranged on said printing means for detecting the edges of a sheet of paper being fed along said paper path by said paper advancing means and, wherein said control means includes printer control means responsive to said paper sensing means for positioning said printing means in a desired printing position with respect to the edges of a sheet of paper to effect printing thereon.

34. The integrated printer and paper feeding apparatus of claim 33 further including printer drive means for driving said printing means transversely across a sheet of paper being fed along said paper feed path by said paper advancing means in response to said sensing means.

35. The integrated printer and paper feeding apparatus of claim 1 further including paper ejecting means arranged within said housing along an exit portion of said paper path for engaging a sheet of paper being advanced by said paper advancing means and ejecting the engaged sheet of paper into said paper receptacle means.

36. The integrated printer and paper feeding apparatus of claim 33 wherein said printer control means is responsive to said paper sensing means detecting the leading edge of a sheet of paper being advanced along said paper path for controlling said paper advancing means to position said leading edge of said sheet of paper in a predetermined leading edge position relative to said printing means and responsive to said paper sensing means sensing a side edge of said sheet of paper to position said printing means with respect to said side edge of said sheet of paper in a predetermined side edge position to effect printing on said sheet of paper.

37. The integrated printer and paper feeding apparatus of claim 36 wherein said paper sensing means comprises a single paper sensor.

38. The integrated printer and paper feeding apparatus of claim 1, wherein said housing is defined by a plurality of walls and further includes sound absorbing means arranged along the interior walls thereof for absorbing sound produced by the operation of said apparatus.

39. The integrated printer and paper feeding apparatus of claim 38, wherein said supply opening closing means of said paper storing means and said paper retrieval cover member include sound absorbing means thereon for engagement with said housing to seal said paper supply opening and said paper retrieval opening when said paper storing means is inserted through said paper supply opening and mounted within said housing and when said paper retrieval cover member closes said paper retrieval opening.

40. The integrated printer and paper feeding apparatus of the claim 1, wherein said openable retrieval cover member overlies said paper receptacle means.

41. The integrated printer and paper feeding apparatus of claim 1, wherein said first housing part comprises a walled enclosure having an open top end, and wherein said second housing part comprises a top cover movable between a closed position and an open position with respect to said open top end of said first housing part, said top cover including a bottom wall overlying said open top end of said first housing part when said top cover is in said closed position.

42. The integrated printer and paper feeding apparatus of claim 41 wherein said paper retrieval opening comprises a U-shaped recess in said top cover and said paper retrieval cover member is mounted to said top cover adjacent said U-shaped recess, said paper retrieval cover member being movable between a first position in which said paper retrieval cover closes said U-shaped recess to provide a substantially flush top wall for said housing and a second position in which access is provided to said U-shaped recess, and wherein said paper receptacle means is positioned in said U-shaped recess.

43. An integrated printer and paper feeding apparatus comprising:

a housing providing a sound-proofing enclosure for sheets of paper to be moved along a paper path which extends from a paper supply station past a printing station to a paper retrieval station, said paper supply station, said printing station and said paper retrieval station being located interiorly of said housing;

said housing including a paper supply opening therein adjacent said paper supply station for providing access to said paper supply station, and a paper retrieval opening provided in said housing adjacent said paper retrieval station for providing access to said paper retrieval station, said paper supply opening and said paper retrieval opening being provided at spaced locations from one another in said housing, and said housing being constructed to provide a substantially closed enclosure, except for said paper supply opening and said paper retrieval opening, for sheets of paper moved along said paper path to thereby minimize sound eminating from within said housing during operation of the integrated printer and paper feeding apparatus;

said housing further including an openable paper retrieval cover member adjacent said paper retrieval opening, said paper retrieval cover member being operative to substantially close said paper retrieval opening in said housing, and being openable to provide access to said paper retrieval station for removing sheets of paper therefrom;

paper storing means for storing a plurality of individual sheets of paper, said paper storing means being removably insertable through said paper supply opening in said housing for mounting said paper storing means within said housing at said paper supply station so that said individual sheets of paper stored in said paper storing means are completely contained within said housing, said paper storing means including supply opening closing means arranged thereon for closing said paper supply opening of said housing when said paper storing means is inserted through said paper supply opening and mounted within said housing;

paper feeding means arranged within said housing at said paper supply station for feeding individual sheets of paper along said paper supply means along a feed portion of said paper path when said paper supply means is inserted through and mounted within said housing, said feed portion of said paper path extending from said paper supply station toward said printing station;

printing means arranged at said printing station within said housing for printing on a sheet of paper;

paper advancing means arranged within said housing along said paper path for advancing a sheet of paper fed by said paper feeding means past said printing means to effect printing thereon and for thereafter advancing said sheet of paper after printing has been effected thereon along an exit portion of said paper path toward said paper retrieval station within said housing, said exit portion of said paper path extending from said printing station to said paper retrieval station;

paper receptacle means arranged at said paper retrieval station within said housing for receiving and storing sheets of paper advanced by said paper advancing means from said printing means;

paper ejecting means arranged within said housing along said exit portion of said path and adjacent said paper receptacle means for engaging a sheet of paper being advanced along said exit portion of said paper path by said paper advancing means and ejecting the engaged sheet of paper into said paper receptacle means;

said housing including a first housing part and a second housing part, said first housing part having said paper supply opening therein and having said paper feeding means and said printing means contained interiorly therewithin, and said second housing part having said paper retrieval opening therein and having said paper receptacle means contained therewithin, said second housing part further being openable with respect to said first housing part to provide access to the interior of said first housing part; and control means for controlling the operation of said paper feeding means, said printing means, said paper advancing, and said paper ejecting means, whereby said housing together with said supply opening closing means on said paper storing means and said openable paper retrieval cover member provide a substantially closed enclosure for said paper feeding means, said printing means, said paper advancing means, and said paper ejecting means, and for said individual sheets of paper before, during and after printing is effected thereon to minimize sound eminating from within said housing during operation of said printing and paper feeding apparatus.

44. The integrated printer and paper feeding apparatus of claim 43 further including a manual paper feed path for manually feeding individual sheets of paper from a supply external to said housing to said paper advancing means and an envelope feed path for feeding individual envelopes from a supply within said housing to said paper advancing means.

45. The integrated printer and paper feeding apparatus of claim 43 wherein said paper ejecting means includes a pair of spaced apart rollers arranged on opposite sides of said exit portion of said paper path, one of said rollers being movable between an open position spaced adjacent the other of said rollers and a closed position in contact with said other of said rollers; and further including a paper gripping mechanism comprising a paper bail movable within said housing between a closed position in contact with said paper advancing means and an open position spaced adjacent said paper advancing means, a sector gear rotatable in opposite directions, connecting means for connecting said paper bail and said one roller to said sector gear, and rotating means for rotating said sector gear in first and second opposite directions, said sector gear moving said paper bail from said closed position to said open position during rotation of said sector gear in said first direction while permitting said one roller to remain in said open position and moving said one roller from said open position to said closed position upon rotation of said sector gear in said second direction while permitting said paper bail to remain in said closed position.

46. The integrated printer and paper feeding apparatus of claim 45 wherein said connecting means comprises a cable having a center portion secured to said sector gear and a retaining member secured at each of the terminal ends of said cable.

47. The integrated printer and paper feeding apparatus of claim 46 further including first and second arms having a center portion pivotally mounted to said housing, said first arm having said paper bail attached at one end thereof and said retaining member at one end of said cable slidingly captured within an opening provided within the other end of said first arm, said cable causing pivotal movement of said first arm upon rotation of said sector gear in said first direction, said second arm having said one roller attached at one end thereof and said retaining member at the other end of said cable slidingly captured within an opening provided within the other end of said second arm, said cable causing pivotal movement of said second arm upon rotation of said sector gear in said second direction.

48. The integrated printer and paper feeding apparatus of claim 47 further including a spring contained within said opening of said second arm through which said cable passes and arranged to be compressed by said retaining member at said other end of said cable when said sector gear is rotated in said second direction to pivot said one roller from said open position to said closed position into engagement with said second member.

49. The integrated printer and paper feeding apparatus of claim 46 further including sensing means for sensing the rotation of said sector gear in said second direction wherein said one roller moves from said open position to said closed position.

50. The integrated printer and paper feeding apparatus of claim 46 wherein said rotating means comprises a motor adapted to rotate said sector gear in said first direction to a position wherein said paper bail is spaced from said paper advancing means in said open position, to rotate said sector gear in said second direction to a position wherein said one roller engages said other roller in said closed position, and to rotate said sector gear to a central position wherein said paper bail is in said closed position and said one roller is in said open position.

51. The integrated printer and paper feeding apparatus of claim 43 further including envelope storing means for storing a plurality of individual envelopes in a stack and envelope feeding means for feeding the lowermost envelope from said stack to said paper advancing means along an envelope feed path, said envelope feeding means arranged along one side of said envelope feed path for engagement with a portion of the lowermost envelope in said stack.

52. The integrated printer and paper feeding apparatus of claim 51 further including an envelope stripper for the individual stripping of envelopes from said stack, said envelope stripper comprising envelope stripping means arranged along the other side of said envelope feed path for engaging an upper envelope adjacent said lowermost envelope, said envelope stripping means having a portion arranged within said envelope feed path for retaining said upper envelope within said stack while permitting said lowermost envelope to be fed from said stack by operation of said envelope feeding means to said paper advancing means.

53. The integrated printer and paper feeding apparatus of claim 52 wherein said envelope storing means comprises an envelope support plate terminating adjacent the leading end of said stack of envelopes to define an overlapping strip therebetween and a weight overlying said strip and pivotably mounted to said envelope support plate.

54. The integrated printer and paper feeding apparatus of claim 53 wherein said envelope feeding means is arranged underlying said strip and adjacent said envelope support plate and wherein said leading end of said stack of envelopes is pressed into engagement with said envelope feeding means by said weight.

55. The integrated printer and paper feeding apparatus of claim 52 wherein said envelope feeding means comprises a roller arranged transversely extending and underlying said leading end of said stack of envelopes within said envelope storing means.

56. The integrated printer and paper feeding assembly of claim 52 wherein said envelope stripping means comprises a member transversely extending adjacent the leading end of said envelopes within said stack, said member being arranged to include a portion extending into said envelope feed path for engagement with an envelope being fed from said envelope storing means along said envelope feed path.

57. The envelope stripper mechanism of claim 56 wherein the coefficient of friction between said member and an envelope is greater then the coefficient of friction between two overlying envelopes.

58. The integrated printer and paper feeding apparatus of claim 43 wherein said paper supply opening comprises a first paper supply opening; wherein said paper storing means comprises a first paper tray having a plurality of individual sheets therein; and wherein said paper feeding means comprises first paper feeding means for engagement with said sheets of paper within said first paper tray, said first paper tray being arranged within said housing underlying said first paper feeding means.

59. The integrated printer and paper feeding apparatus of claim 58 wherein said housing includes a second paper supply opening; and further including a second paper tray having a plurality of individual sheets of paper therein and second paper feeding means for feeding individual sheets of paper from said second paper tray along said feed portion of said paper path, said second paper tray being removably insertable through said second paper supply opening for mounting within said housing spaced from said first paper tray within said housing so that said sheets of paper stored in said second paper supply tray are completely contained within said housing, and said second paper tray being arranged underlying said second paper feeding means for engagement of said second paper feeding means with said sheets of paper within said second paper tray.

60. The integrated printer and paper feeding apparatus of claim 59 wherein said first and second paper feeding means comprise guide means for defining said feed portion of said paper path between said paper storing means and said paper advancing means, and first and second transversely spaced drive rollers for driving a sheet of paper respectively from said first and second paper trays along said feed portion of said paper path to said paper advancing means.

61. The integrated printer and paper feeding apparatus of claim 60 wherein said control means comprises a drive gear operatively coupled to said first drive roller through a first clutch operable upon rotation in one direction and operatively coupled to said second drive roller through an idler gear and a second clutch operable upon rotation in said one direction, and a motor for rotation of said drive gear in a forward direction to effect rotation of said first clutch in said one direction and in an opposite direction to effect rotation of said second clutch in said one direction, whereby said first and second drive rollers are respectively rotated.

62. The integrated paper feeding apparatus of claim 43 further including feed sensing means arranged within said feed portion of said paper path for detecting the presence of a sheet of paper within said feed portion of said paper path and for generating an error signal in the absence of detecting said sheet of paper within a predetermined time from operation of said control means for said paper feeding means.

63. The integrated printer and paper feeding apparatus of claim 43 further including an envelope feed path for feeding individual envelopes from a supply of said envelopes within said housing to said paper advancing means and feed sensing means arranged within said envelope feed path for detecting the presence of an envelope within said envelope feed path and for generating an error signal in the absence of detecting said envelope within a predetermined time from feeding of said envelope from said supply along said envelope feed path.

64. The integrated printer and paper feeding apparatus of claim 63 further including envelope sensing means for detecting the presence of envelopes within said supply thereof and for generating an error signal in the absence of detecting said envelopes within said supply during operation of said apparatus.

65. The integral printer and paper feeding apparatus of claim 43 further including paper sensing means for detecting the presence of paper within said paper storing means and for generating an error signal in the absence of detecting said paper within said paper storing means during operation of said apparatus.

66. The integrated printer and paper feeding apparatus of claim 62 wherein said printer control means is responsive to said paper sensing means detecting the leading edge of a sheet of paper being advanced along said feed portion of said paper path for controlling said paper advancing means to position said leading edge of said sheet of paper in a predetermined leading edge position relative to said printing means and responsive to said paper sensing means sensing a side edge of said sheet of paper to position said printing means with respect to said side edge of said sheet of paper in a predetermined side edge position to effect printing on said sheet of paper.

67. The integrated printer and paper feeding apparatus of claim 66 wherein said paper sensing means comprises a single paper sensor.

68. The integrated printer and paper feeding apparatus of claim 43 wherein said first housing part comprises a walled enclosure having an open top end, and wherein said second housing part comprises a top cover movable between a closed position and an open position with respect to said open top end of said first housing part, said top cover including a bottom wall overlying said open top end of said first housing part when said top cover is in said closed position.

69. The integrated printer and paper feeding apparatus of claim 68 wherein said paper retrieval opening comprises a U-shaped recess in said top cover and said paper retrieval cover member is mounted to said top cover adjacent said U-shaped recess, said paper retrieval cover member being movable between a first position in which said paper retrieval cover closes said U-shaped recess to provide a substantially flush top wall for said housing and a second position in which access is provided to said U-shaped recess, and wherein said paper receptacle means is positioned in said U-shaped recess.

70. An integrated printer and paper feeding apparatus comprising:

a housing:

paper storing means within said housing for storing a plurality of individual sheets of paper;

paper feeding means within said housing for feeding individual sheets of paper from said paper storing means along a paper feed path;

printing means within said housing for printing on a sheet of paper;

paper advancing means arranged within said housing along said paper feed path for advancing a sheet of paper past said printing means to effect printing thereon;

control means for controlling the operation of said paper feeding means, said printing means and said paper advancing means; and a paper gripping mechanism for engaging paper being moved through said apparatus, said paper gripping mechanism including: (a) paper gripping means arranged adjacent said paper advancing means and movable between a first position in which a sheet of paper is gripped between said paper gripping means and said paper advancing means and a second position in which said paper gripping means is spaced from said paper advancing means; (b) a first member and a second member positioned along a paper exit path, said first member being movable between a first position in which said first member is spaced from said second member and a second position in which a sheet of paper is gripped between said first and second member; (c) paper gripping controlling means for controlling the movement of said paper gripping means and said first member between said respective first and second positions, said paper gripping controlling means being movable in a first direction and a second direction; and (d) connection means for coupling said paper gripping means and said first member to said paper gripping controlling means so that said paper gripping means moves from said first position toward said second position when said paper gripping controlling means is moved in said first direction, and so that said first member moves from said first position toward said second position when said paper gripping controlling means is moved in said second direction.

71. The integrated printer and paper feeding apparatus of claim 70 wherein said paper gripping means pivots from said first position toward said second position while said first member remains in said first position when said paper gripping controlling means is moved in said first direction.

72. The integrated printer and paper feeding apparatus of claim 70 wherein said first member pivots from said first position toward said second position while said paper gripping means remains in said first position when said paper gripping controlling means is moved in said second direction.

73. The integrated printer and paper feeding apparatus of claim 70 further including rotating means for rotating said paper gripping control means alternatively between said first direction and said second direction.

74. The integrated printer and paper feeding apparatus of claim 70 further including a pulley attached to said paper gripping controlling means for securing said connecting means to said paper gripping controlling means.

75. The integrated printer and paper feeding apparatus of claim 70 further including sensing means for sensing movement of said paper gripping controlling means in said second direction wherein said first member moves from said first toward said second position.

76. The integrated and paper feeding apparatus of claim 70 further including spring biasing means for biasing said paper gripping means towards said first position into engagement with said paper advancing means.

77. The integrated printer and paper feeding apparatus of claim 70 further including spring biasing means for biasing said first member towards said first position spaced adjacent said second member.

78. The integrated printer and paper feeding apparatus of claim 70 wherein said paper gripping controlling means comprises a sector gear having first and second terminal ends and journaled within said housing.

79. The integrated printer and paper feeding apparatus of claim 78 wherein said sector gear includes a stop member at said first and second terminal ends.

80. The integrated printer and paper feeding apparatus of claim 70 wherein said connecting means comprises a cable having a center portion secured to said paper gripping controlling means.

81. The integrated printer and paper feeding apparatus of claim 80 wherein said cable includes a retaining member secured at the terminal ends of said cable.

82. The integrated printer and paper feeding apparatus of claim 81 further including an arm having a portion pivotally mounted within said housing, said arm having said paper gripping means attached at one end thereof and said retaining member slidingly captured within an opening provided within the other end of said arm.

83. The integrated printer and paper feeding apparatus of claim 81 further including an arm having a portion pivotally mounted within said housing, said arm having said first member attached at one end thereof and said retaining member slidingly captured within an opening provided within the other end of said arm.

84. The integrated printer and paper feeding apparatus of claim 83 further including a spring contained within said opening through which said cable passes and arranged to be compressed by said retaining member when said paper gripping controlling means is moved in said second direction to pivot said first member from said first to said second position into engagement with said second member.

85. The integrated printer and paper feeding apparatus of claim 70 wherein said paper gripping controlling means further includes a motor for the simultaneous rotation of said paper gripping means and said second member.

86. An integrated printer and paper feeding apparatus comprising:

a housing;

paper storing means within said housing for storing a plurality of individual sheets of paper;

paper feeding means within said housing arranged overlying said paper storing means for feeding individual sheets of paper from said paper storing means along a paper feed path;

paper printing means within said housing for printing on a sheet of paper;

paper advancing means arranged within said housing along said paper feed path for advancing a sheet of paper past said printing means to effect printing thereon;

paper ejecting means arranged within said housing along a paper exit path for engaging a sheet of paper from within said paper advancing means and ejecting the engaged sheet of paper from said apparatus, said paper ejecting means including a pair of spaced apart rollers arranged on opposite sides of said paper exit path, one of said rollers being movable between an open position spaced adjacent the other of said rollers and a closed position in contact with the other of said rollers;

control means for controlling the operation of said paper feeding means, said paper printing means, said paper advancing means, and said paper ejecting means; and a paper gripping mechanism for engaging paper being moved through said apparatus by said paper advancing means, said paper gripping mechanism comprising: (a) a paper ball movable within said housing between a closed position in contact with said paper advancing means and an open position spaced adjacent said paper advancing means; (b) a sector gear rotatable in opposite directions; (c) connecting means for connecting said paper bail and said one roller of said paper ejecting means to said sector gear; and (d) rotating means for rotating said sector gear in first and second opposite directions, said sector gear moving said paper bail from said closed position to said open position during rotation of said sector gear in said first direction while permitting said one roller to reamin in said open position and moving said one roller from said open position to said closed position upon rotation of said sector gear in said second direction while permitting said paper bail to remain in said closed position.

87. The integrated printer and paper feeding apparatus of claim 86 wherein said connecting means comprises a cable having a center portion secured to said sector gear and a retaining member secured at each of the terminal ends of said cable.

88. The integrated printer and paper feeding apparatus of claim 87 further including first and second arms having a center portion pivotally mounted to said housing, said first arm having said paper bail attached at one end thereof and said retaining member at one end of said cable slidingly captured within an opening provided within the other end of said first arm, said cable causing pivotal movement of said first arm upon rotation of said sector gear in said first direction, said second arm having said one roller attached at one end thereof and said retaining member at the other end of said cable slidingly captured within an opening provided within the other end of said second arm, said cable causing pivotal movement of said second arm upon rotation of said sector gear in said second direction.

89. The integrated printer and paper feeding apparatus of claim 88 further including a spring contained within said opening of said second arm through which said cable passes and arranged to be compressed by said retaining member at said other end of said cable when said sector gear is rotated in said second direction to pivot said one roller from said open position to said closed position into engagement with said second member.

90. The integrated printer and paper feeding apparatus of claim 87 further including sensing means for sensing the rotation of said sector gear in said second direction wherein said one roller moves from said open position to said closed position.

91. The integrated printer and paper feeding apparatus of claim 87 wherein said rotating means comprises a motor adapted to rotate said sector gear in said first direction to a position wherein said paper bail is spaced from said paper advancing means in said open position, to rotate said sector gear in said second direction to a position wherein said one roller engages said other roller in said closed position, and to rotate said sector gear to a central position wherein said paper bail is in said closed position and said one roller is in sid open position.

92. An integrated printer and paper feeding apparatus comprising:

a housing;

paper storing means within said housing for storing a plurality of individual sheets of paper;

paper feeding means within said housing for feeding individual sheets of paper from said paper storing means along a paper feed path;

printing means within said housing for printing on a sheet of paper;

paper advancing means arranged within said housing along said paper feed path for advancing a sheet of paper past said printing means to effect printing thereon;

control means for controlling the operation of said paper feeding means, said printing means and said paper advancing means;

said paper storing means comprising a first paper tray having a plurality of individual sheets of paper therein and a second paper tray having a plurality of individual sheets of paper therein, said first and second paper trays being spaced from one another within said housing;

said paper feeding means comprising a first paper feeding device for engagement with said sheets of paper within said first paper tray and a second paper feeding device for engagement with said sheets of paper within said second paper tray, said first and second paper feeding devices comprising guide means for defining said paper feed path between said first and second paper trays respectively and said paper advancing means, and first and second transversely spaced feed rollers for feeding a sheet of paper respectively from said first and second paper trays along said paper feed path to said paper advancing means; and wherein said control means includes a drive gear operatively coupled to said first feed roller through a first clutch and operatively coupled to said second feed roller through an idler gear and a second clutch, said first clutch being operable upon rotation in one direction and said second clutch being operable upon rotation in said one direction.

93. The integrated printer and paper feeding apparatus of claim 92 wherein said control means further includes a motor for rotation of said drive gear in a forward direction to effect rotation of said first clutch in said one direction and in an opposite direction to effect rotation of said second clutch in said one direction, whereby said first and second feed rollers are respectively rotated.

94. An integrated printer and paper feeding apparatus comprising:

a housing;

paper storing means within said housing for storing a plurality of individual sheets of paper;

paper feeding means within said housing arranged overlying said paper storing means for feeding individual sheets of paper from said paper storing means along a paper feed path;

paper printing means within said housing for printing on a sheet of paper;

paper advancing means arranged within said housing along said paper feed path for advancing a sheet of paper past said printing means to effect printing thereon;

paper ejecting means arranged within said housing along a paper exit path for engaging a sheet of paper from within said paper advancing means and ejecting the engaged sheet of paper from said apparatus;

control means for controlling the operation of said paper feeding means, said paper printing means, said paper advancing means and said paper ejecting means;

said paper storing means comprising a first paper tray having a plurality of individual sheets of paper therein and a second paper tray having a plurality of individual sheets of paper therein, said first and second paper trays being spaced from one another within said housing;

said paper feeding means comprising a first paper feeding device for engagement with said sheets of paper within said first paper tray and a second paper feeding device for engagement with said sheets of paper within said second paper tray, said first and second paper feeding devices comprising guide means for defining said paper path between said first and second paper trays respectively and said paper advancing means, and first and second transversely spaced feed rollers for feeding a sheet of paper respectively from said first and second paper trays along said paper feed path to said paper advancing means; and wherein said control means includes a drive gear operatively coupled to said first feed roller through a first clutch and operatively coupled to said second feed roller through an idler gear and a second clutch, said first clutch being operable upon rotation in one direction and said second clutch being operable upon rotation in said one direction, and a motor for rotation of said drive gear in a forward direction to effect rotation of said first clutch in said one direction and in an opposite direction to effect rotation of said second clutch in said one direction, whereby said first and second drive rollers are respectively rotated.

* * * * *